US009598852B2

(12) United States Patent
O'Neal

(10) Patent No.: US 9,598,852 B2
(45) Date of Patent: Mar. 21, 2017

(54) CONSTRUCTION SYSTEM

(71) Applicant: Murphy Reynolds O'Neal, Auckland (NZ)

(72) Inventor: Murphy Reynolds O'Neal, Auckland (NZ)

( * ) Notice: Subject to any disclaimer, the term of this patent is extended or adjusted under 35 U.S.C. 154(b) by 0 days.

(21) Appl. No.: 14/663,542

(22) Filed: Mar. 20, 2015

(65) Prior Publication Data

US 2015/0308095 A1 Oct. 29, 2015

(51) Int. Cl.

| | |
|---|---|
| ***E04B 1/19*** | (2006.01) |
| ***E04H 12/18*** | (2006.01) |
| ***E04B 1/343*** | (2006.01) |
| *E04B 1/58* | (2006.01) |

(52) U.S. Cl.

CPC ..... *E04B 1/34326* (2013.01); *E04B 1/34315* (2013.01); *E04B 1/5825* (2013.01); *E04H 12/18* (2013.01)

(58) Field of Classification Search

CPC ..... E04B 1/19; E04B 2001/1924; E04B 2001/1933; E04B 1/0903; E04B 1/1912; E04B 1/1909; E04B 2001/1966; E04B 2001/1975; E04H 12/18; E04H 12/187

USPC ..... 52/645, 646, 653.1

See application file for complete search history.

(56) References Cited

U.S. PATENT DOCUMENTS 3,890,022 A * 6/1975 Moon ..... A47B 47/0008 312/111
3,921,360 A * 11/1975 Baldwin ..... E04B 1/1906 403/171
4,610,561 A * 9/1986 Cecchellero ..... E04B 1/1912 403/171
4,678,359 A * 7/1987 Keen ..... A47B 47/0008 312/140
4,925,330 A * 5/1990 Cornish ..... E04B 1/1912 403/169
5,033,901 A * 7/1991 Dias ..... E04B 1/1912 403/172
5,111,631 A * 5/1992 Flood ..... A47F 5/14 52/646
6,338,226 B1 * 1/2002 Gauthier ..... A01G 9/14 47/17
6,378,265 B1 * 4/2002 Konstandt ..... E04B 1/1903 403/171
6,390,719 B1 * 5/2002 Chan ..... E04B 1/5806 403/205
6,516,955 B1 * 2/2003 Dudhwala ..... A47B 47/0008 211/182

(Continued)

FOREIGN PATENT DOCUMENTS

CN WO 2011050492 A1 * 5/2011 ..... A47B 47/0016

*Primary Examiner* — Phi A
(74) *Attorney, Agent, or Firm* — Garcia Zamor IP Law; Ruy M. Garcia-Zamor

(57) ABSTRACT

A construction system comprising an elongate column member, an elongate beam member and at least one connector member. Each of the elongate members comprising an interior engaging portion 3B. The connector member includes a protruding keying portion 12 and mating formation 13. When the elongate column member and elongate beam members are engaged with the connector member in use, the interior engaging portion slidably receives the mating formation therein. The elongate members have a keying portion on an outside of their body to allow connection to a wall frame.

13 Claims, 25 Drawing Sheets

(56) References Cited

U.S. PATENT DOCUMENTS

| | | | | |
|---|---|---|---|---|
| 6,553,698 | B1 * | 4/2003 | Kemeny | G09F 15/0068 160/135 |
| 6,758,354 | B2 * | 7/2004 | Carletti | G09F 15/0068 211/182 |
| 7,204,064 | B2 * | 4/2007 | Cazzolaro | E04B 1/3441 24/546 |
| 8,020,328 | B2 * | 9/2011 | Lavi | A47B 47/0016 40/605 |
| 8,789,335 | B2 * | 7/2014 | Davis | E04H 3/24 52/645 |
| 2002/0059770 | A1 * | 5/2002 | Fritsche | G09F 15/0062 52/645 |
| 2002/0189191 | A1 * | 12/2002 | Strassle | A47B 47/0016 52/655.2 |
| 2008/0110127 | A1 * | 5/2008 | Terada | F16B 7/185 52/646 |
| 2009/0313938 | A1 * | 12/2009 | Li | E04B 1/19 52/656.9 |
| 2011/0047925 | A1 * | 3/2011 | Gan | E04B 1/2403 52/653.1 |
| 2014/0150370 | A1 * | 6/2014 | Daas | B66C 23/70 52/646 |

* cited by examiner

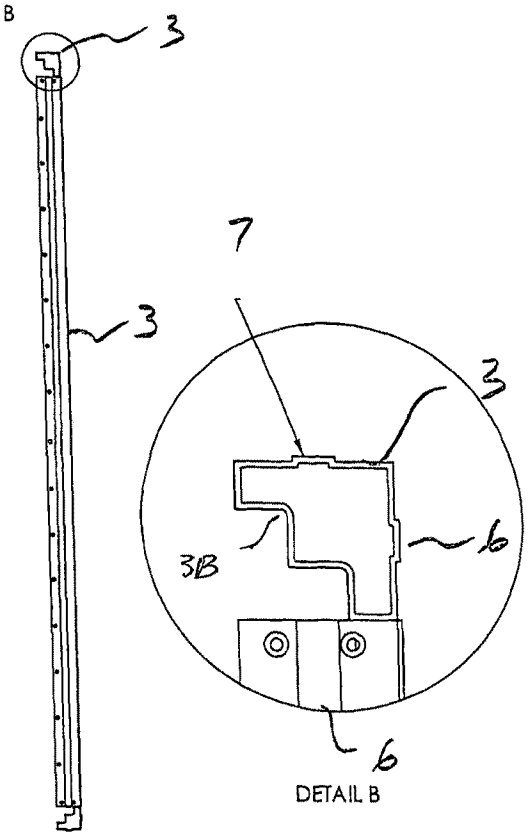
FIGURE 18
FIGURE 19
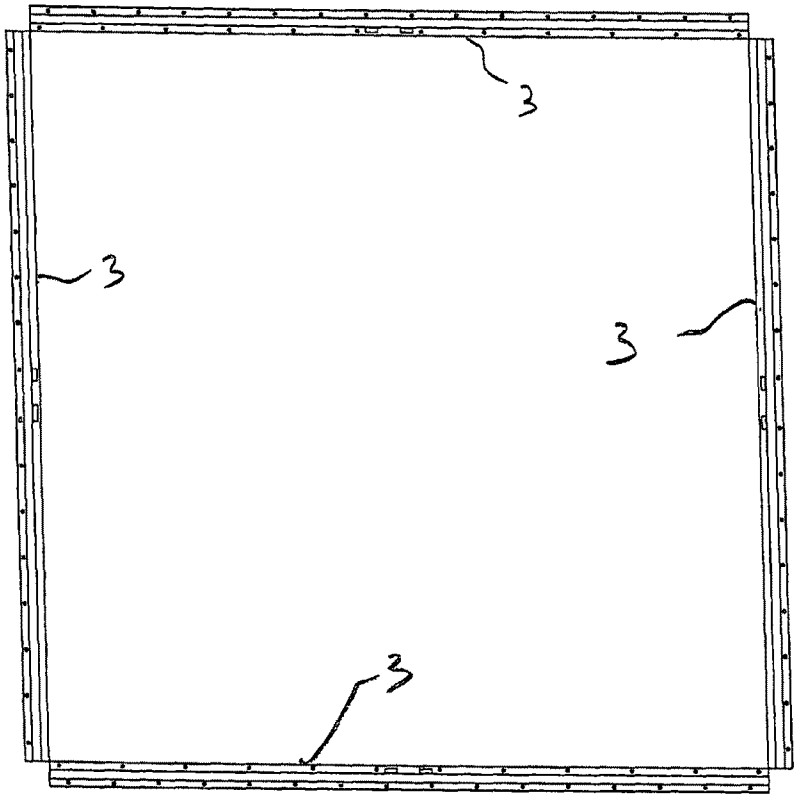
FIGURE 16
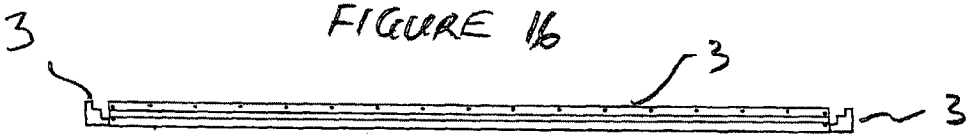
FIGURE 17

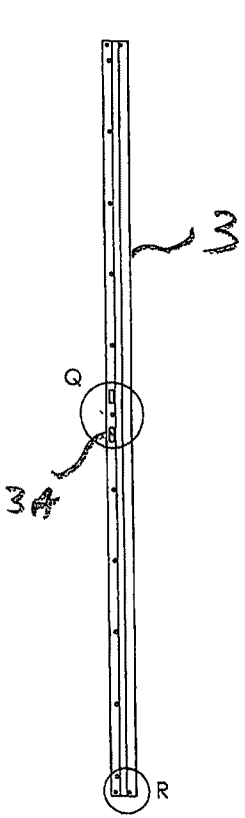
FIGURE 25
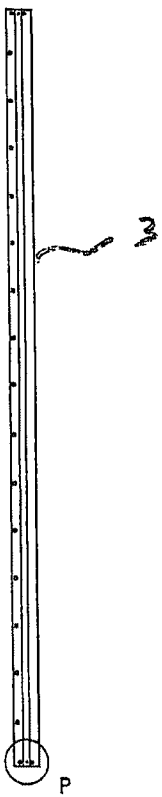
FIGURE 26
FIGURE 28
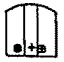
DETAIL P
FIGURE 27
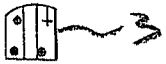
DETAIL R
FIGURE 29
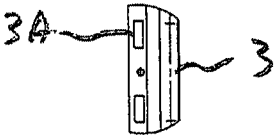
DETAIL Q
FIGURE 30

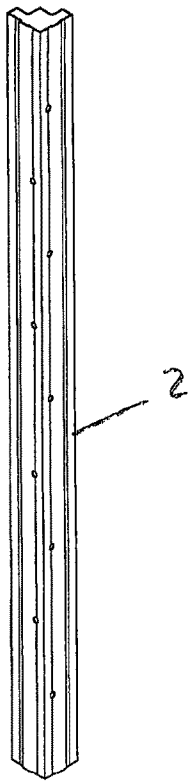
FIGURE 41
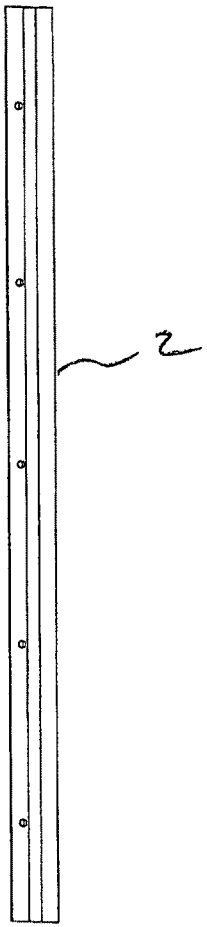
FIGURE 40
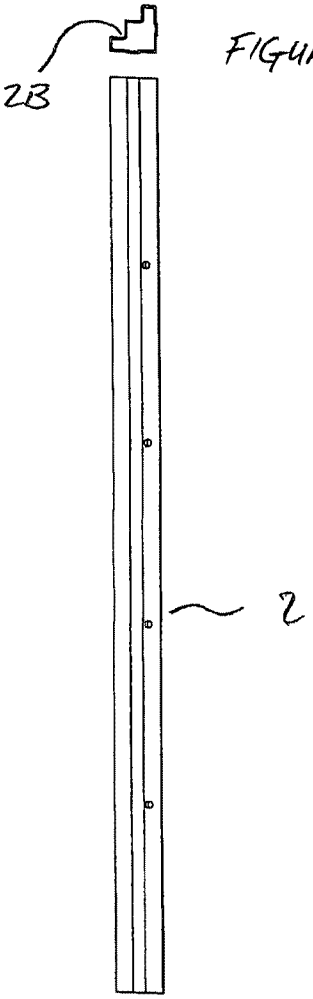
FIGURE 39
FIGURE 38

SECTION A-A

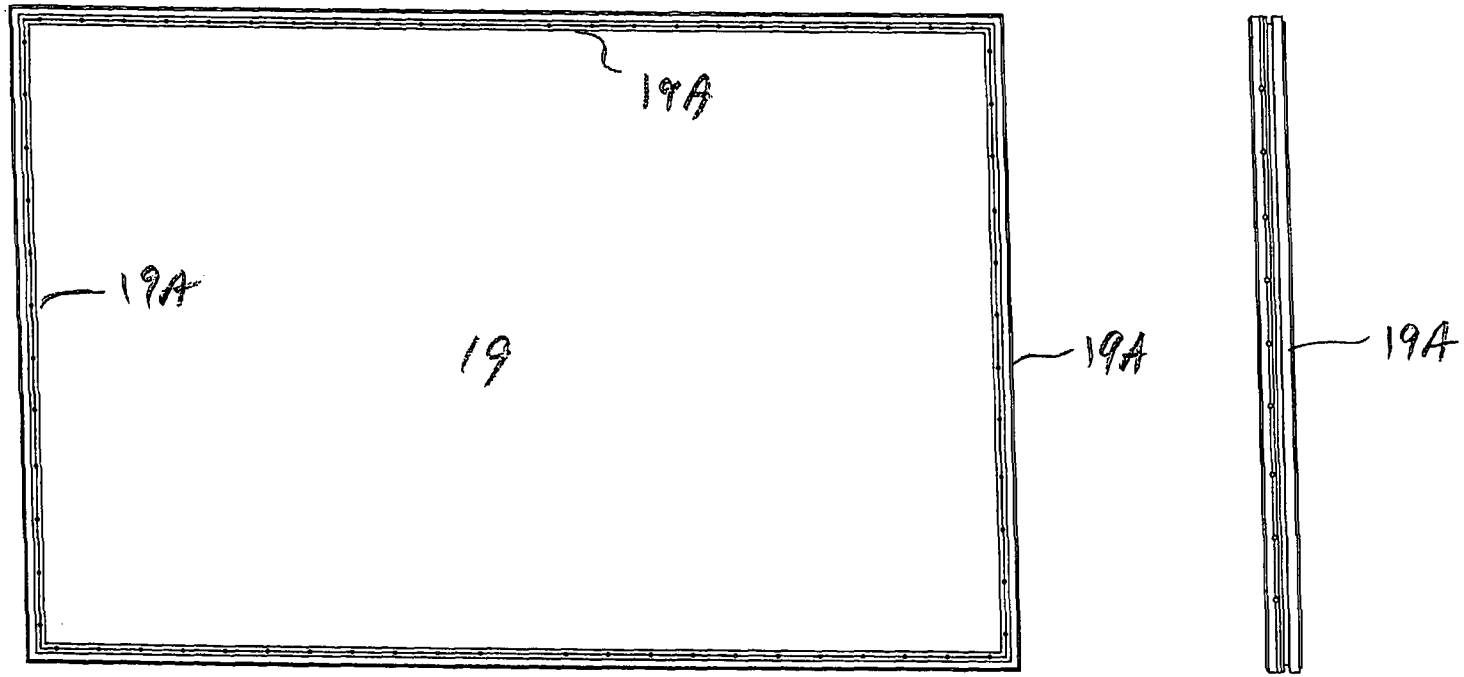
FIGURE 48
FIGURE 50
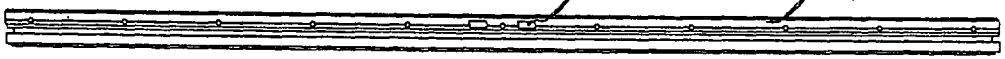
FIGURE 49

DETAIL B

SECTION A-A

CONSTRUCTION SYSTEM

The present invention relates to a construction system, and in particular, but not exclusively, to modular construction system for buildings and other structures.

BACKGROUND TO THE INVENTION

A number of modular construction systems exist, whereby preformed beams and columns are connected together to form a frame to which cladding can be attached. Many such systems are relatively flimsy, and so are only useful for creating relatively small structures such as sheds or temporary shelters.

Existing construction systems typically have many parts and components making them expensive to manufacture and difficult to assemble especially in remote locations.

A further problem with many of the construction systems of the prior art is that they must be constructed by skilled workers in order to achieve the desired levels of strength and, if relevant, weathertightness.

The reference to any prior art in the specification is not, and should not be taken as, an acknowledgement or any form of suggestion that the prior art forms part of the common general knowledge in any country.

OBJECT OF THE INVENTION

It is an object of the present invention to provide a construction system which will overcome or ameliorate one or more of the problems referred to above, or at least one which will provide a useful choice.

Other objects of the present invention may become apparent from the following description, which is given by way of example only.

BRIEF SUMMARY OF THE INVENTION

According to one aspect of the present invention there is provided a construction system A construction system comprising an elongate column member, an elongate beam member and at least one connector member, each of the elongate members comprising an interior engaging portion 3B, the connector member includes a protruding keying portion 12 and mating formation 13, wherein, when the elongate column member and elongate beam members are engaged with the connector member in use, the interior engaging portion slidably receives the mating formation therein Preferably the elongate members have a body with at least one protruding keying portion 6, 7 wherein at least one keying portion of the elongate column member extends substantially in-plane with at least one keying portion of the elongate beam member.

Preferably each said keying portion comprises two substantially parallel keying surfaces.

According to a second aspect of the present invention there is provided a construction system comprising an elongate column member, an elongate beam member and at least one connector means, each of the elongate members comprising at least one protruding keying portion, wherein, when the elongate column member and elongate beam members are engaged with the connector member in use, at least one keying portion of the elongate column member extends substantially in-plane with at least one keying portion of the elongate beam member.

Preferably, each elongate member comprises two substantially orthogonal faces, each said face comprising the protruding keying portion.

Preferably the connector member includes a body in a box shape with an outer surface with at least a first, second and third faces, the body having an exterior surface, wherein the first face is a horizontal surface provided with at least one protruding keying portion 12 and second and third faces are vertical faces provided with the matting formations 13 wherein the second and third faces are mutually orthogonal and are orthogonal to the first face and there are fourth face and fifth faces, being front faces at right angles to each other with keying portions 12A.

Preferably the interior engaging portion of each elongate member is provided in at least an end portion of an interior of the body which is shaped (eg stepped 3A) to slidably engage with the matting formations 13 of the connector means wherein the interior is shaped to provide as stepped shape as a female part and the mating formation 13 is provided by a stepped formation as a male part.

Preferably the elongate member is provided with an interior which is shaped to slidably engage with the matting formations 13 of the connector means.

Preferably, the keying portion extends over substantially an entire length of the elongate member.

Preferably each of the said keying portions is substantially continuous.

Preferably each of the keying portions comprises a raised rib located on an outside surface of the elongate member.

Preferably the elongate column members are provided with at least one end cap member member slidably received in at least one end of the elongate column member wherein an outer surface of the end cap member includes female keying portions in a cross shape, which are adapted to be slidably received by the at least one protruding keying portion 12 of the first face of the connector means.

Preferably the end cap member includes a body with an inner surface and outer surface wherein the inner surface is shaped to complement and sliably interfit with the interior stepped surface of one end of one column member.

Preferably the protruding keying portion of the first face of the connector member is an L shaped protruding formation and is located to bisect the first face leaving a section without the L shaped protruding formation and extends in a downward step along an edge of the mating formation.

Preferably at least two first apertures are provided in the first face extending down to the opposing fourth face, to provide threading engagement of a fastener therein to engage with the end cap member attached to the column member.

Preferably mating formation of the connector member is provide with second apertures for the sliding receipt of a removable pin to allow vertical stacking of the floor or roof framed units and fixing to the end of an elongate member.

Preferably the construction system comprises at least twelve elongate members and at least eight connector means, each of said elongate members comprising at least two keying portions which extend along the length of the said member, each keying portion comprising a keying surface, at least two of the keying surfaces of each elongate member extending in mutually perpendicular directions, the elongate members and connector member being interconnectable to form a substantially cuboid frame defining six faces, wherein, when so connected, a keying surface of the elongate members defining each face extends substantially parallel to the said face wherein at least one of the faces is a vertically oriented face.

Preferably the system includes a wall frame unit for attaching cladding thereto, which is shaped to interfit within one of the vertical faces of cuboid frame, wherein the wall frame unit includes elongate channel members having keying portions 6,7 which are positioned and adapted to be received by being mated and interlocked by receiving by keying portions 6,7 of the beams and columns to seal the wall frame unit to the surrounding cuboid frame.

Preferably the elongate channel members include three box channels whereby there is an outer and inner surface, with the inner in use facing the elongate 4 members of one face, two of the channels are separated from each other by an open channel on the outer surface and the third box channel is removably connected to the inner face with an outer wall being angled inwardly.

Preferably the open channel includes sealing element which are shaped and dimensioned to engage the abutting keying portions of the columns and beams.

Preferably the connector member comprising a body having a first face, a second face and a third face, each of the first second and third faces being perpendicular to the other faces, the first face comprising at least one aperture for receiving a fastener and at least one keying portion, the second and third faces comprising first and second mating formations, each mating formation adapted to engage an inner surface of an elongate hollow member.

Preferably the open channel includes sealing element which are shaped and dimensioned to engage the keying portions of the columns and beams.

According to a third aspect of the present invention there is provided a construction system comprising at least two elongate beam members, at least one elongate column member and at least one connector means, each of said beam members comprising at least one keying portion comprising a keying surface, and the column member comprising at least two keying portions which each comprise at least one keying surface, wherein, when the beam members and column member are engaged with the connector means, in use, a keying surface of each beam member lies in plane with a respective keying surface of the column member.

According to a fourth aspect of the present invention there is provided a construction system comprising at least two elongate beam members, at least one elongate column member and at least one connector means, each of said beam members comprising at least one protruding keying portion, and the column member comprising two protruding keying portions, wherein, when the column member and beam members are engaged with the connector member in use, each of the keying portions of the column member lies in-plane with a keying portion of a respective beam member.

Preferably, the column member comprises two substantially orthogonal faces, each of the faces comprises a protruding keying portion.

Preferably, the keying portion extends over substantially an entire length of the beam member.

Preferably, the keying portion extends over substantially an entire length of the column member. Preferably each of the said keying portions is substantially continuous.

Preferably each of the keying portions comprises a raised rib.

According to a fifth aspect of the present invention there is provided a construction system comprising at least twelve elongate members and at least eight connector means, each of said elongate members comprising at least two keying portions which extend along the length of the said member, each keying portion comprising a keying surface, at least two of the keying surfaces of each elongate member extending in mutually perpendicular directions, the elongate members and connector member being interconnectable to form a substantially cuboid frame defining six faces, wherein, when so connected, a keying surface of the elongate members defining each face extends substantially parallel to the said face.

According to a sixth aspect of the present invention there is provided a construction system comprising at least twelve elongate members and at least eight connector means, each of said elongate members comprising at least two protruding keying portions which extend along the length of the said member and which protrude from the member in mutually perpendicular directions, the elongate members and connector member being interconnectable to form a substantially cuboid frame defining six faces, wherein, when so connected, a keying portion from the elongate members defining each face extends substantially parallel to the said face.

According to a further aspect of the present invention there is provided a connector member for a construction system, the connector member comprising a body being box shaped having a first face, a second face and a third face, each of the first second and third faces being perpendicular to the other faces, the first face comprising at least one aperture for receiving a fastener and at least one keying portion for receiving an end of an elongate column member, the second and third faces comprising first and second mating formations, each mating formation being stepped in shape and adapted to engage a matched inner surface of an elongate hollow beam member.

Preferably the connector member has a fourth and fifth face being front vertical faces which are adapted to provide keying portions which are protruding portions to be received in a slot of an outside surface of a wall frame, wherein the keying portion is a L-shaped protruding portion.

Preferably the first and second mating formations have substantially mirror image transverse cross-sections.

According to a further aspect of the present invention there is provided a method of constructing a construction system which includes the following steps of:

a) Unpack items and inspect for damage;

b) Find a suitable foundation or use plate/blocks on ground to provide a safe grounded area for the construction;

c) Install blocks on one side of all beams using the fasteners provided. Assemble 4 beams into the floor frame;

d) Install floor support beams and flooring substrate (plywood or composite material);

e) Tighten all flooring and flooring beams fasteners;

f) Fasten column onto one wall end, lift and lock wall into the floor beam utilizing the vertical and horizontal keyway system;

g) Fasten column first then install fasteners on the inside of wall. Amount of fasteners depends on strength needed;

h) Repeat step 4.5 until all 4 walls are completed upright and secure;

i) Install blocks on one end of the ceiling beams;

j) Install one beam and secure with fasteners loosely. Repeat this for all 4 beams then tighten fasteners;

k) Install ceiling beams for stacking or flat roof or roof components to complete the weather tight construction.

To those skilled in the art to which the invention relates, many changes in construction and widely differing embodiments and application of the invention will suggest themselves without departing from the scope of the invention as defined in the appended claims. The disclosures and the descriptions herein are purely illustrative and are not intended to be limiting.

According to a still further aspect of the present invention, a building system is substantially as herein described, with reference to the accompanying drawings.

Further aspects of the invention, which should be considered in all its novel aspects, will become apparent from the following description given by way of example of possible embodiments of the invention.

Wall Frame Unit—for Mounting Cladding

Figure 8:
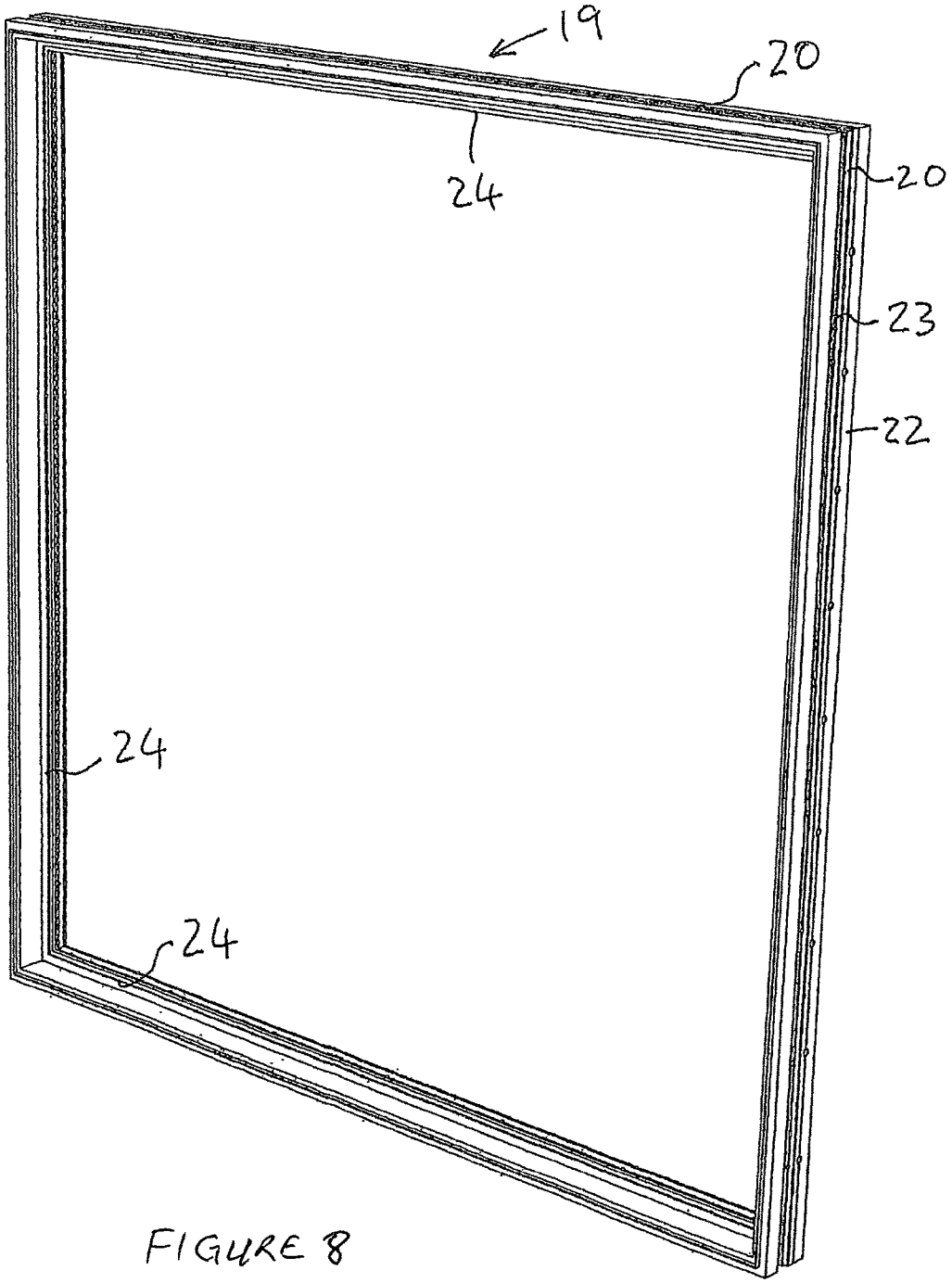

FIG. 8 is an isometric view of a wall frame unit of one embodiment of the present invention.

Figure 9:
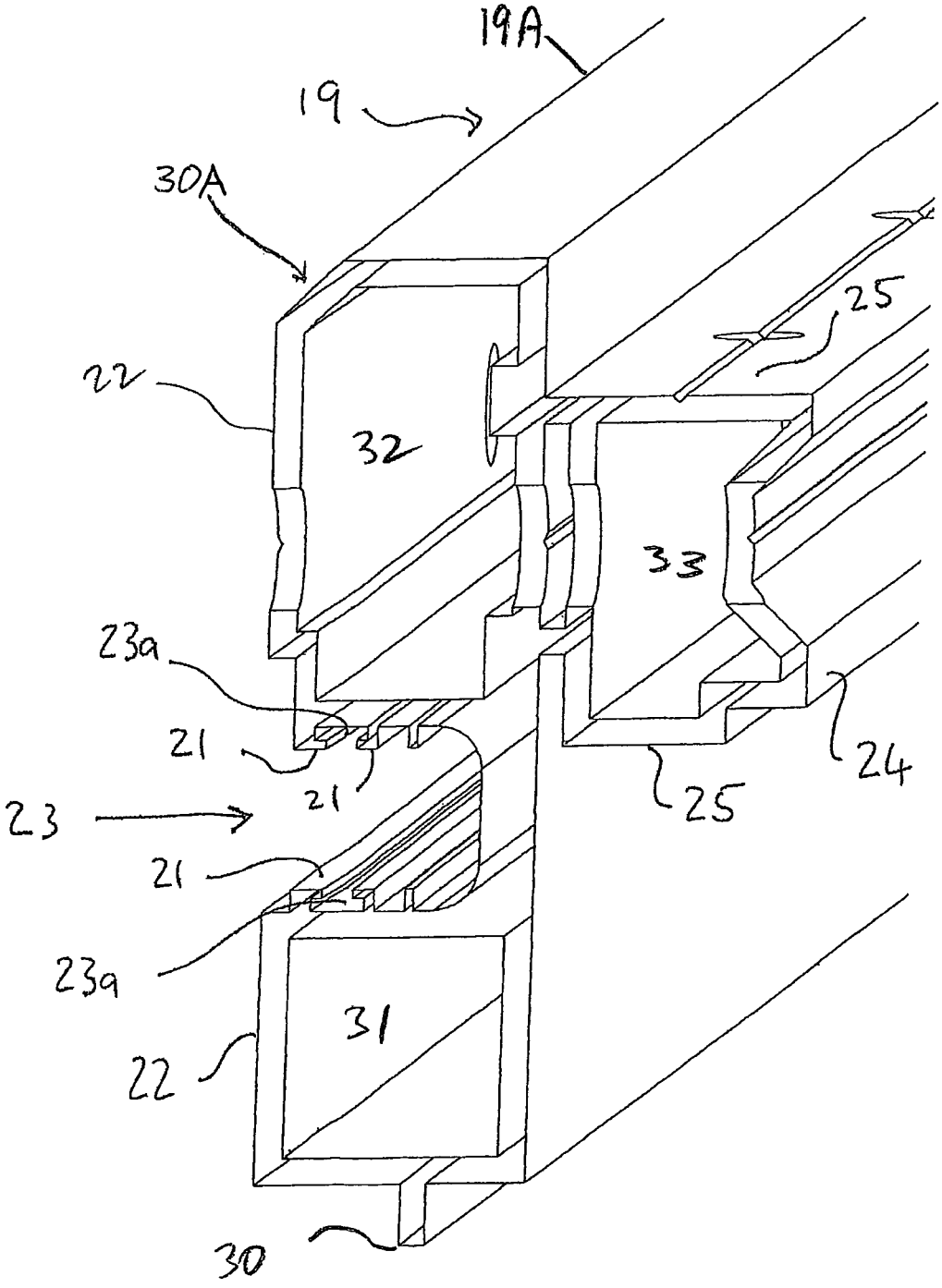

FIG. 9 is an enlarged transverse cross-section of the wall frame unit of FIG. 8.

Figure 10:
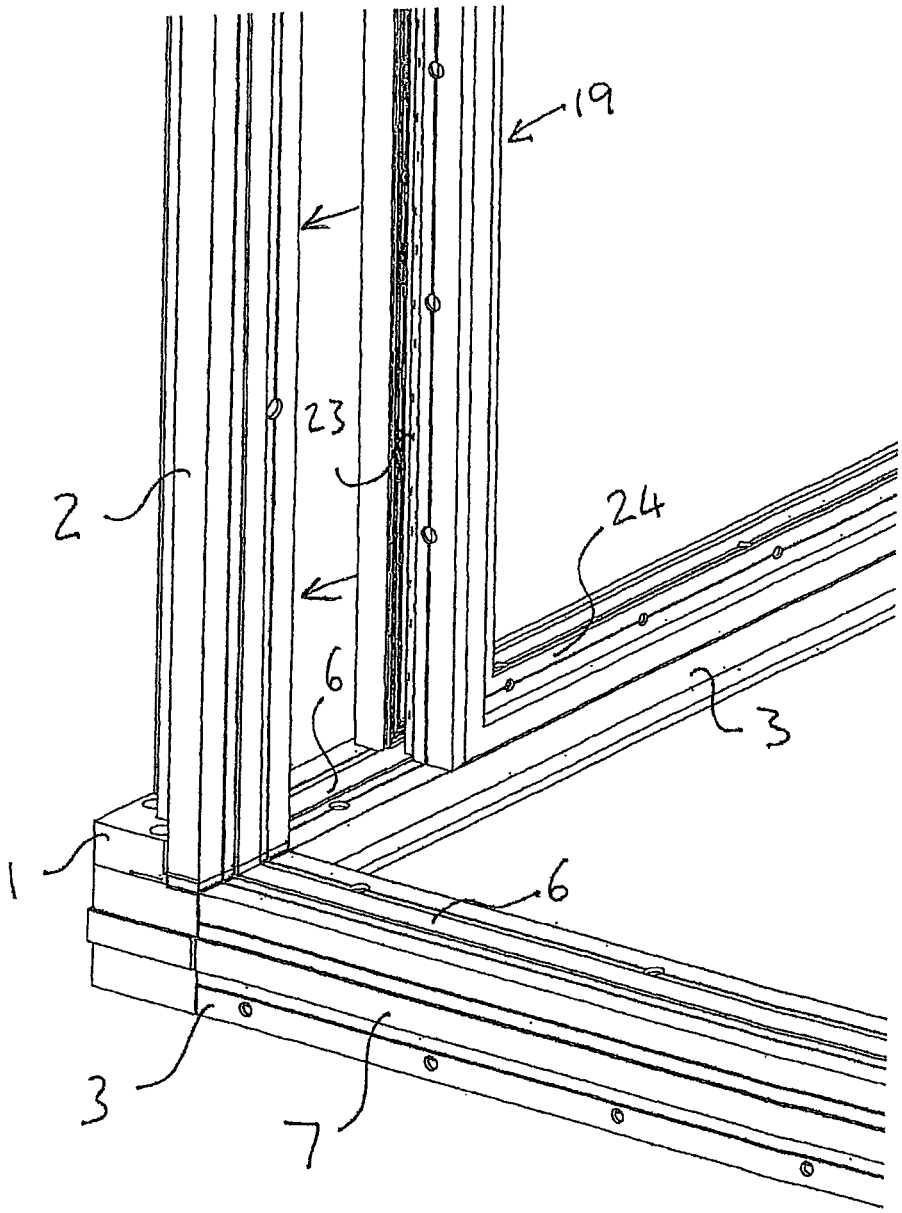

FIG. 10 is an isometric view showing the wall frame unit of FIG. 8 being moved into position.

Figure 11:
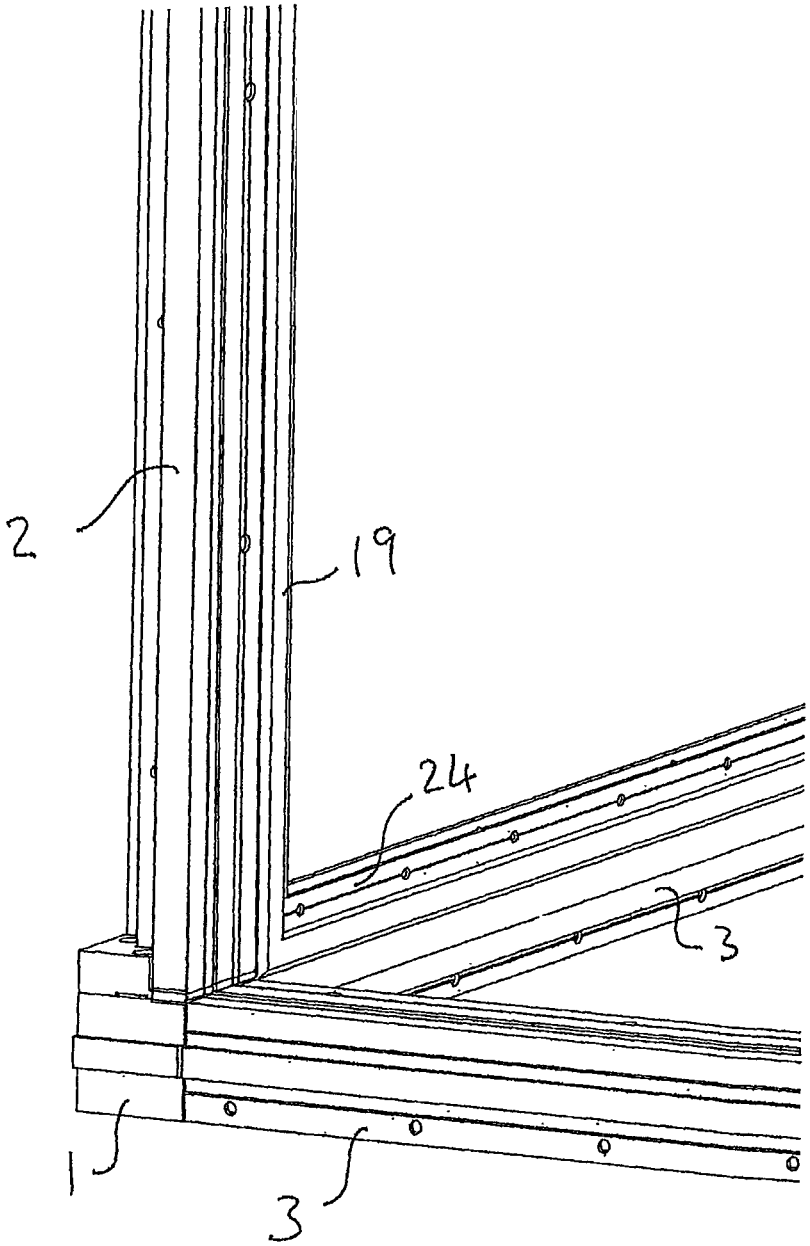

FIG. 11 shows the wall frame unit of FIG. 10 in position.

Figure 7:
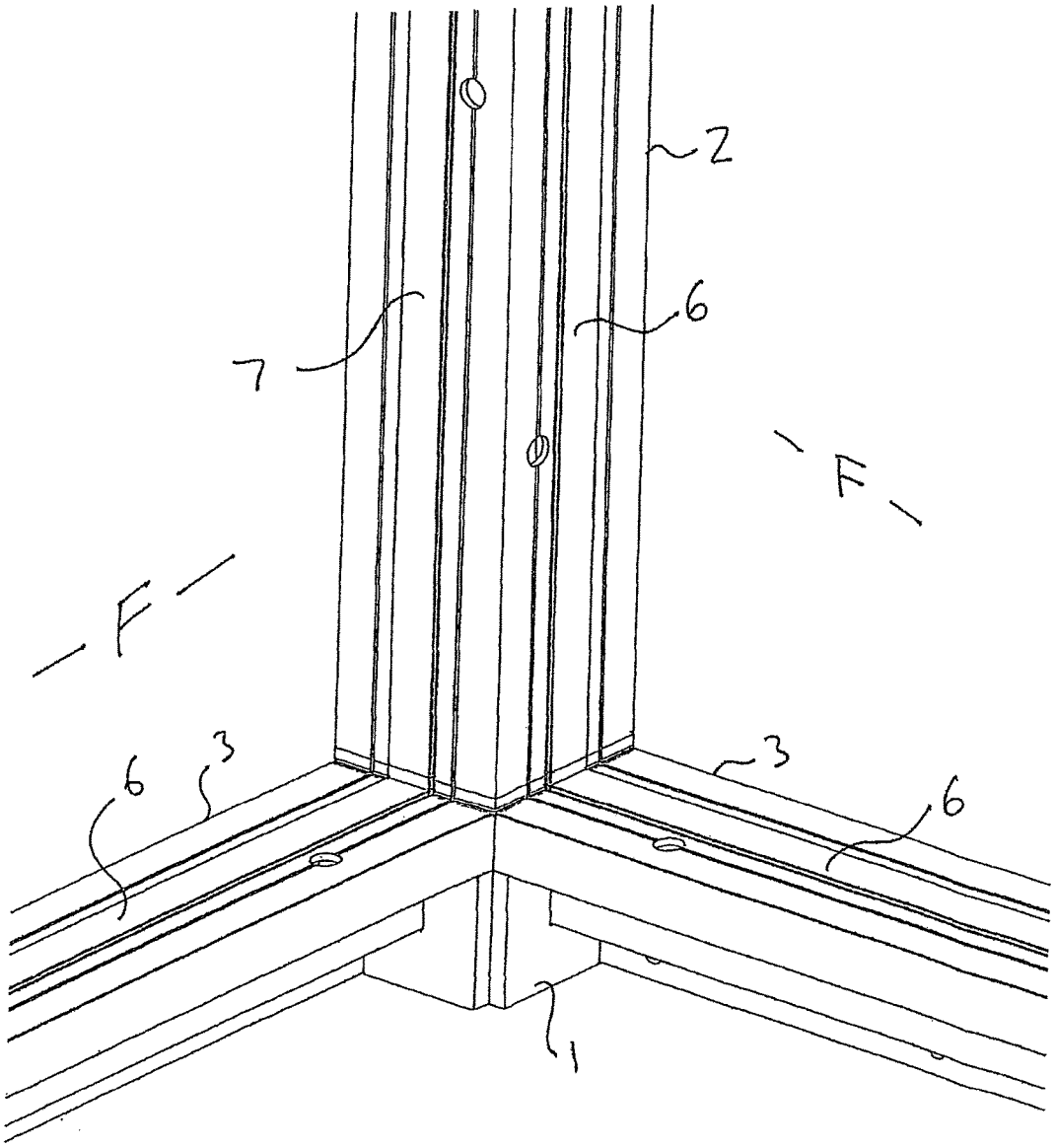
FIG. 7 is an enlarged isometric view an elongate column member and two elongate beam members connected together in use by a connector means.
Figure 12:
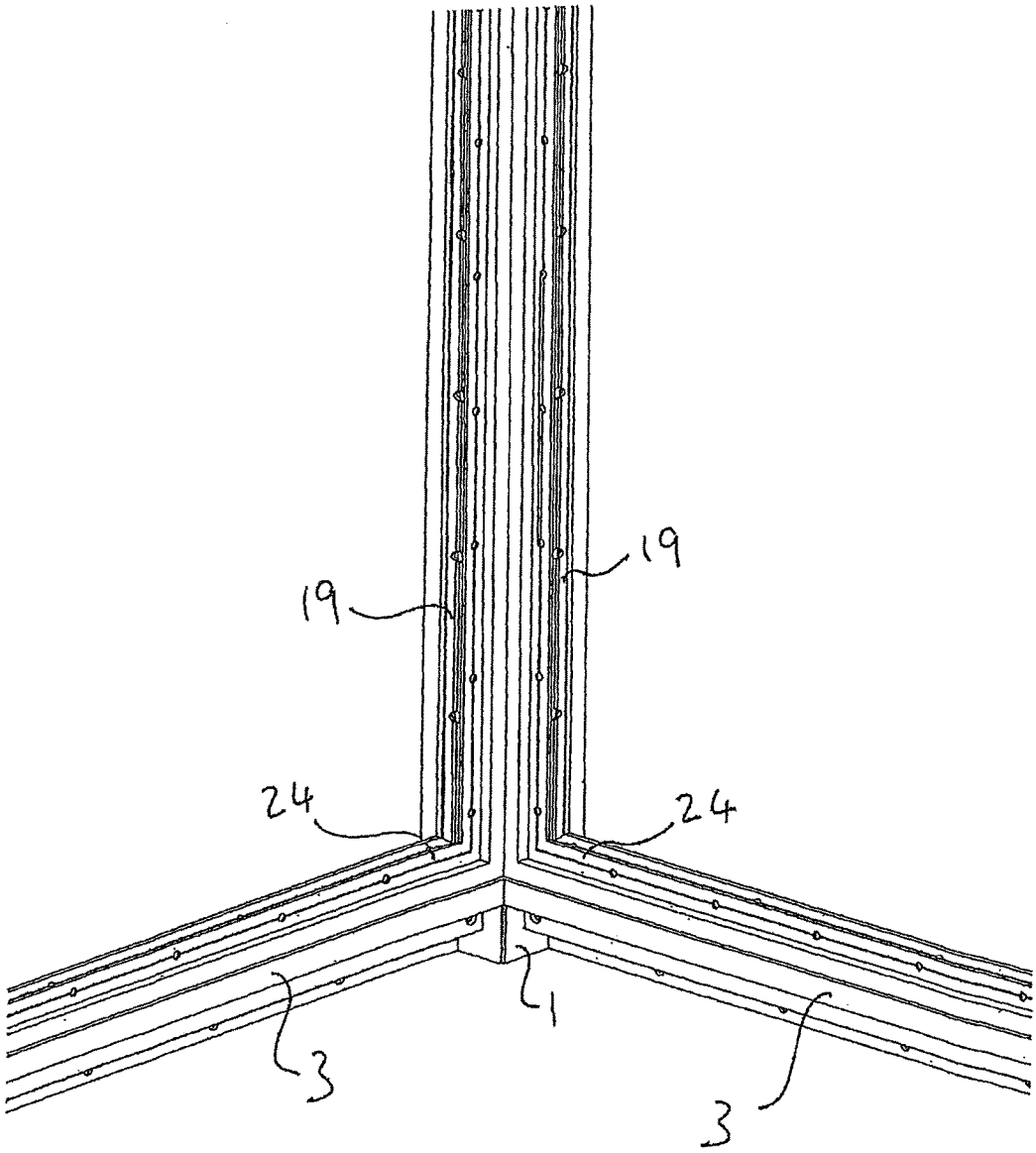

FIG. 12 shows the column member, elongate beam members and connector member of FIG. 7, with two wall frame members mounted in position.

Figure 1:
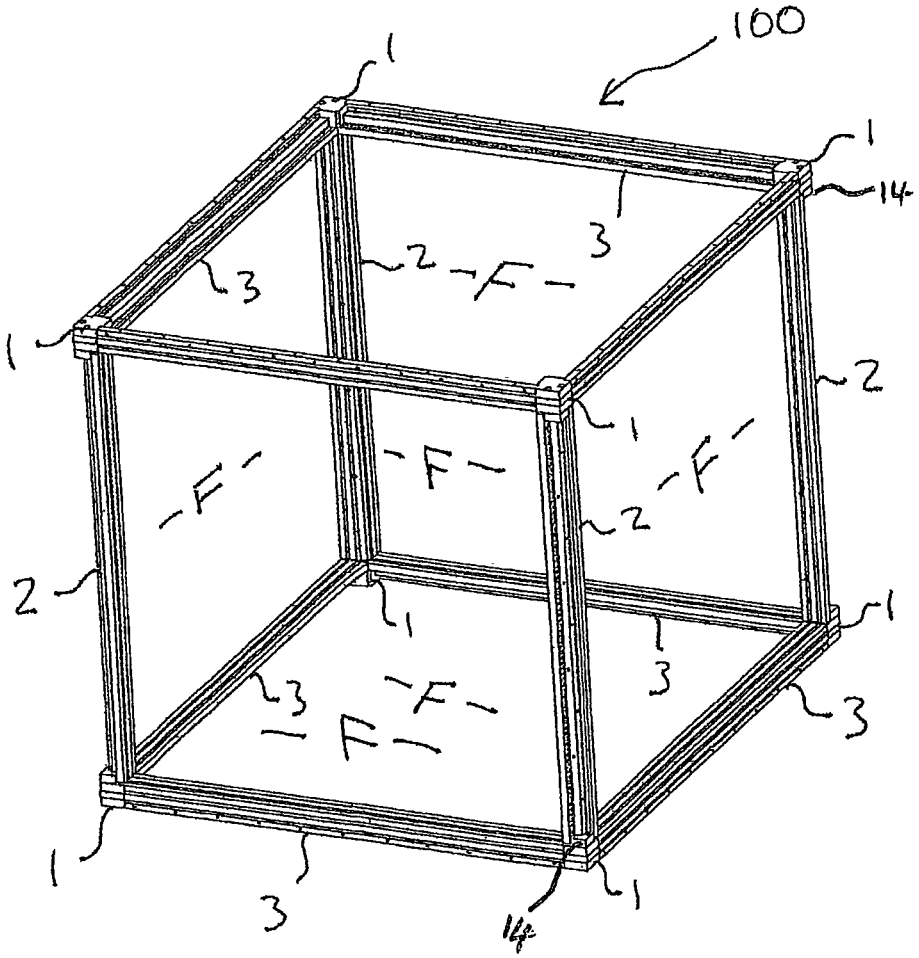
FIG. 1 Is an isometric view of the modular building system of the present invention configured as a substantially cuboid frame.
Figure 13:
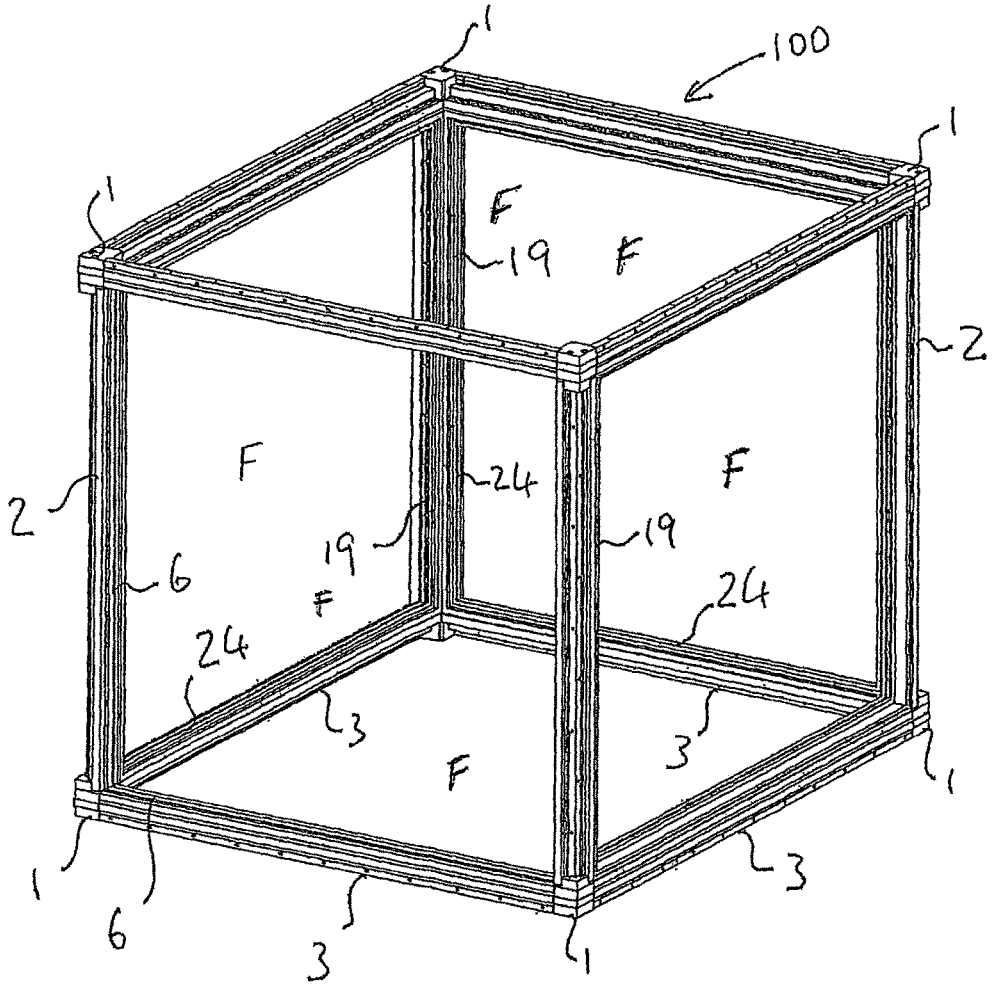

FIG. 13 shows the system of FIG. 1 with three wall frame units mounted in position, and one face having no wall frame unit mounted therein.

Cuboid Beam Column Frame

Figure 14:
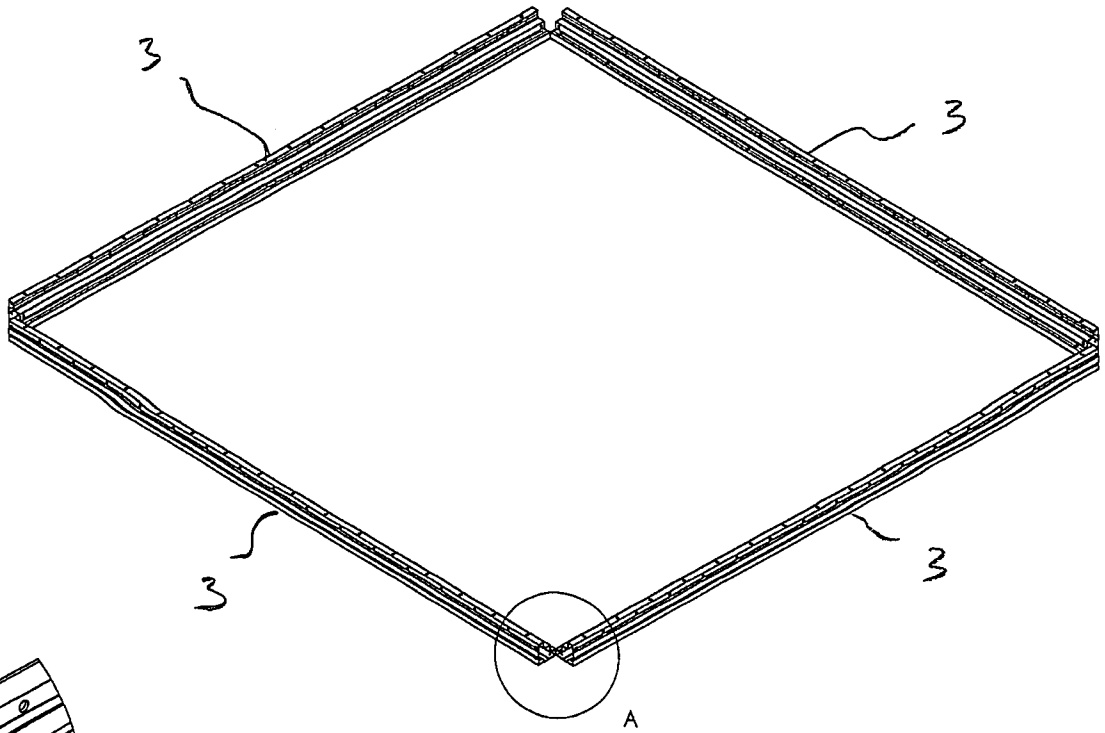

FIG. 14 perspective view of the beams or columns of FIGS. 1-7 before assembly.

Figure 15:
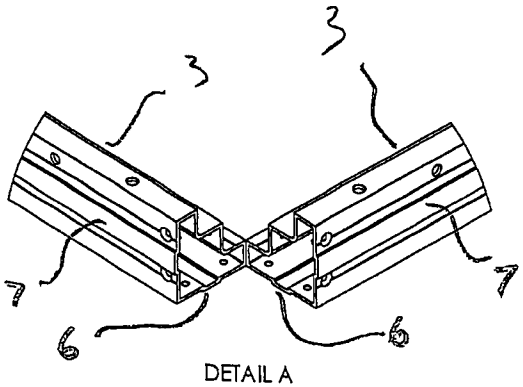

FIG. 15 close up perspective of the corner of FIG. 14.

FIG. 16 is a plan view of the beam frame of FIG. 14.

FIG. 17 is a first side view of the beam frame of FIG. 16.

FIG. 18 is a second side view of the beam frame of FIG. 16.

FIG. 19 shows a close up side view of the corner of FIG. 16.

Figures 20, 21, 22, 23, 24:
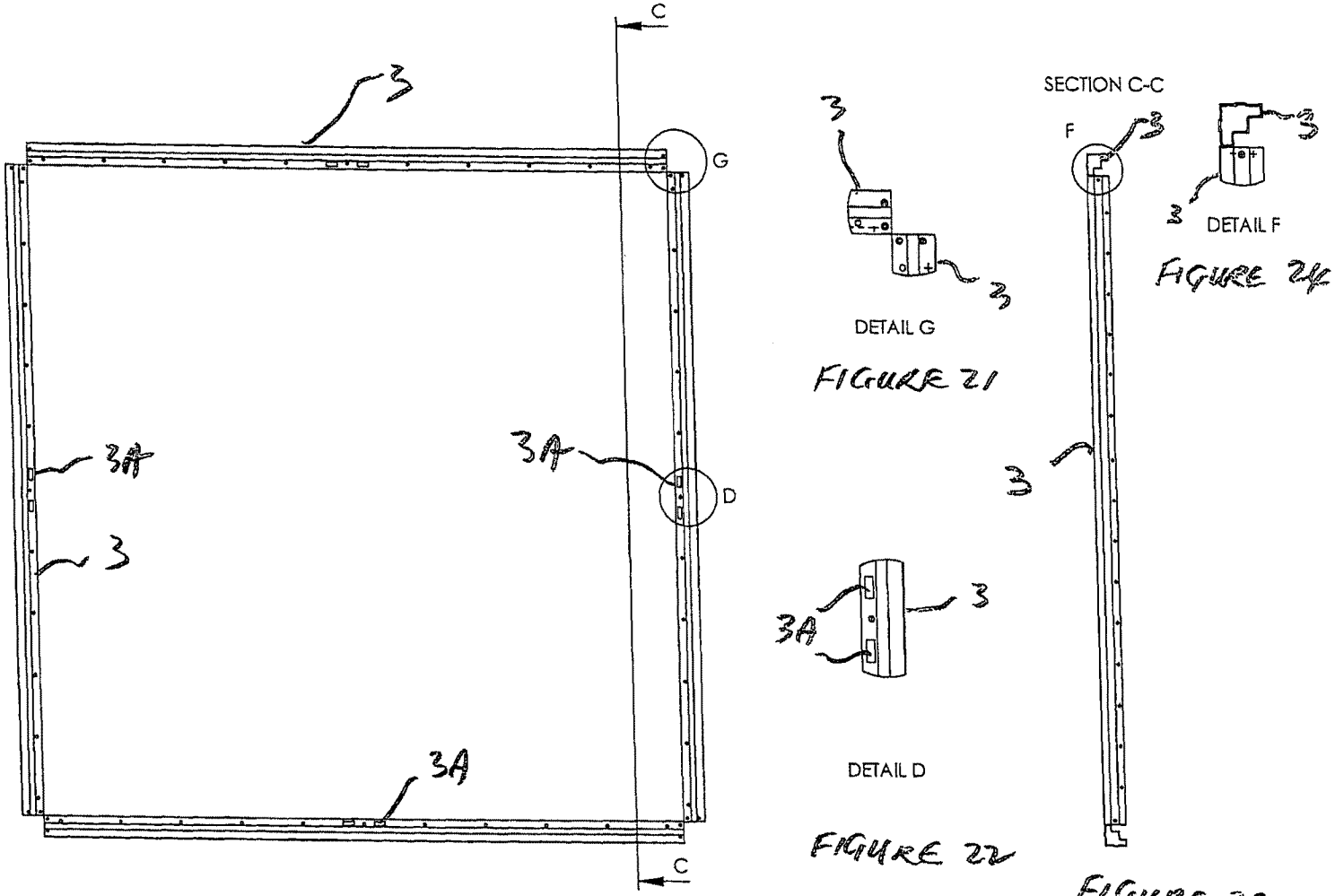

FIG. 20 shows a rear view of the beam frame of FIG. 14 with different features located.

FIG. 21 is a close up plan view of the corner of the beam frame of FIG. 21.

FIG. 22 is a close up plan view of services access way slots.

FIG. 23 is a cross sectional side view of frame of FIG. 20

FIG. 24 is a close up side view of the end corner labeled Detail F

Column Member

FIG. 25 shows a side of a column 2 with bracing slots shown

FIG. 26 is a side view of a column 2 showing location of an end view P.

FIG. 27 shows a close up view Detail P located at an end of the column.

FIG. 28 shows an end view R of the column with utilities or services access way slots.

FIG. 29 shows a side view of the column with slots and location of end view R and Detail Q FIG. 30 shows a close up side view of the access-way slots called Detail Q for bracing.

End Cap Member

Figure 2:
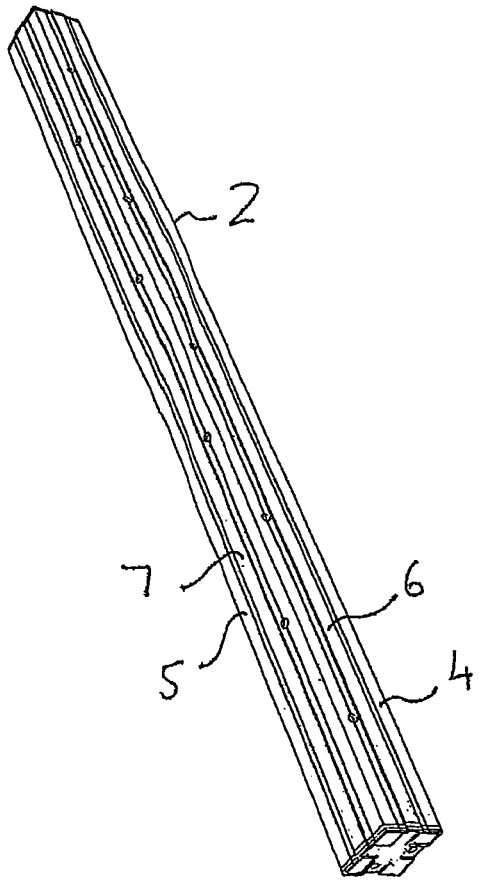
FIG. 2 is an isometric view of an elongate column member of one embodiment of the present invention.
Figure 3:
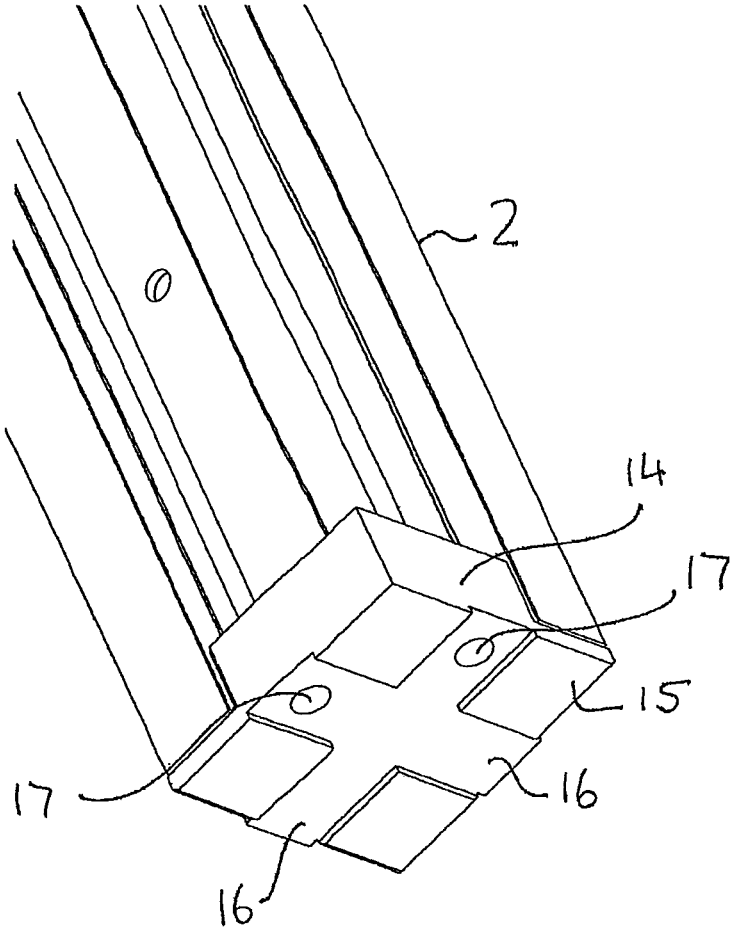
FIG. 3 is an enlarged view of a lower end of the elongate column member shown in FIG. 2.
Figure 31:
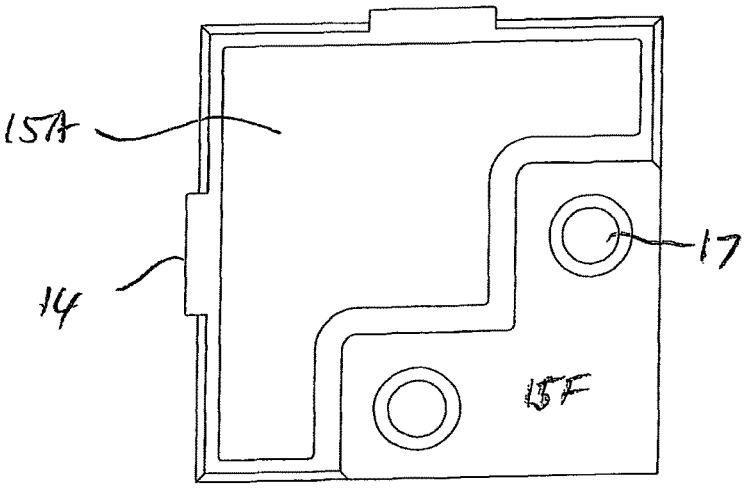

FIG. 31 shows an inner end of the column end cap member 14 as shown in FIGS. 2 and 3.

Figure 32:
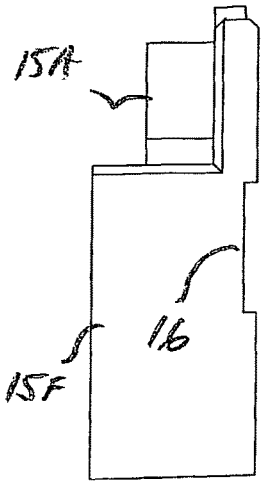

FIG. 32 shows a first side view of the column end cap member.

Figure 33:
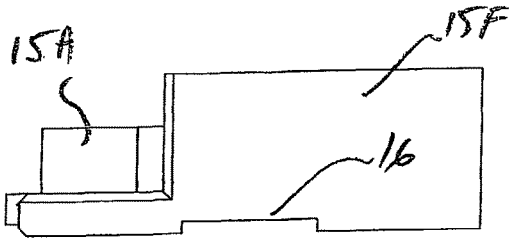

FIG. 33 shows a second side view of the column end cap member.

Figure 34:
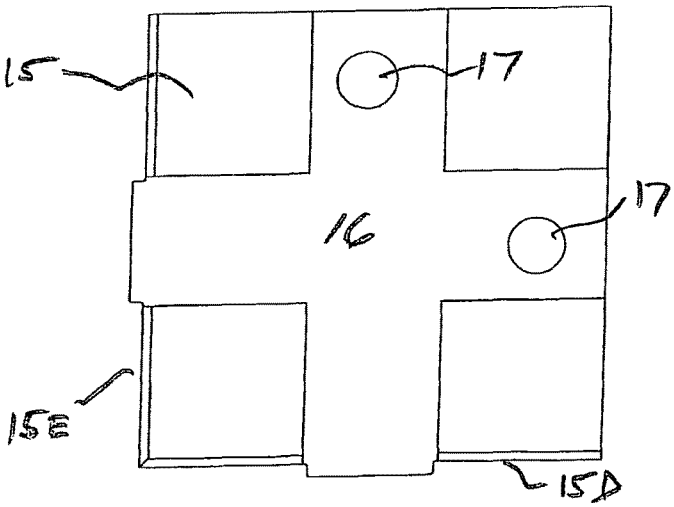

FIG. 34 is an outer end view of the column end cap member.

Figure 35:
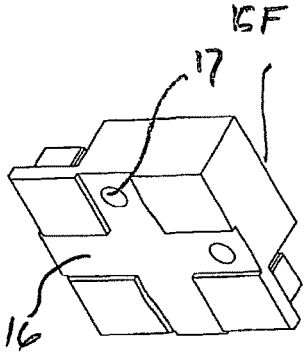

FIG. 35 shows an outer perspective view of the end cap member.

Figure 36:
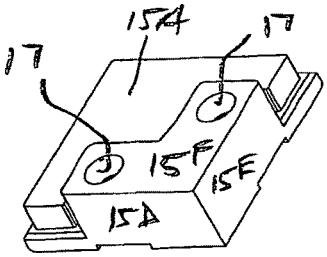

FIG. 36 shows an inner perspective view of the end cap member.

Figure 37:
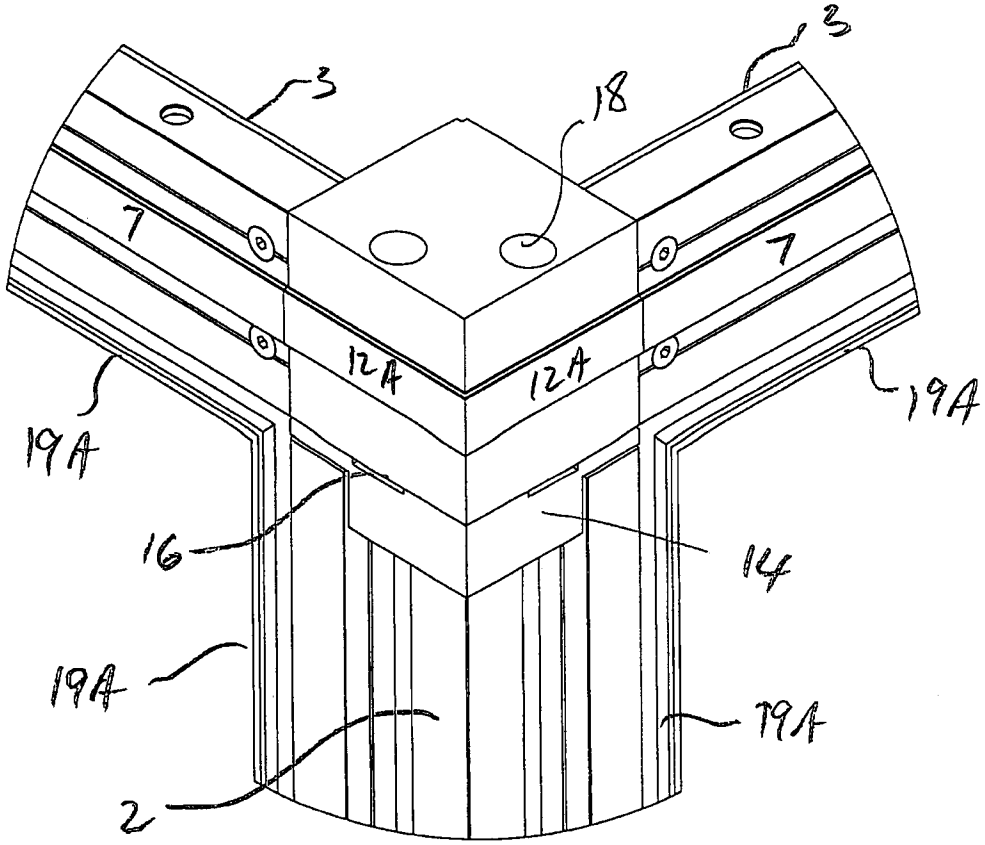

FIG. 37 shows an upper outer perspective view of the connector member 1, connected to the beams 3, end cap member 14 and to column 2

Columns

FIG. 38 is a first side view of the column of FIG. 25

FIG. 39 shows an end view of the column

FIG. 40 is a second view of the column of FIG. 25

FIG. 41 is a perspective view of the column of FIG. 25

Connector Member

Figure 5:
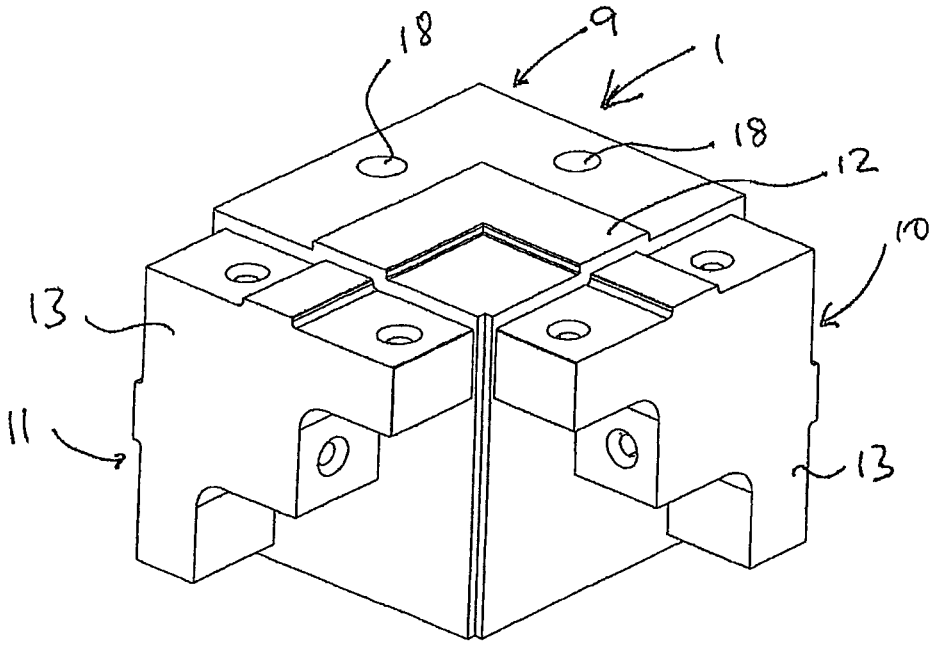
FIG. 5 is an isometric view of a connector member of one embodiment of the present invention.
Figure 6:
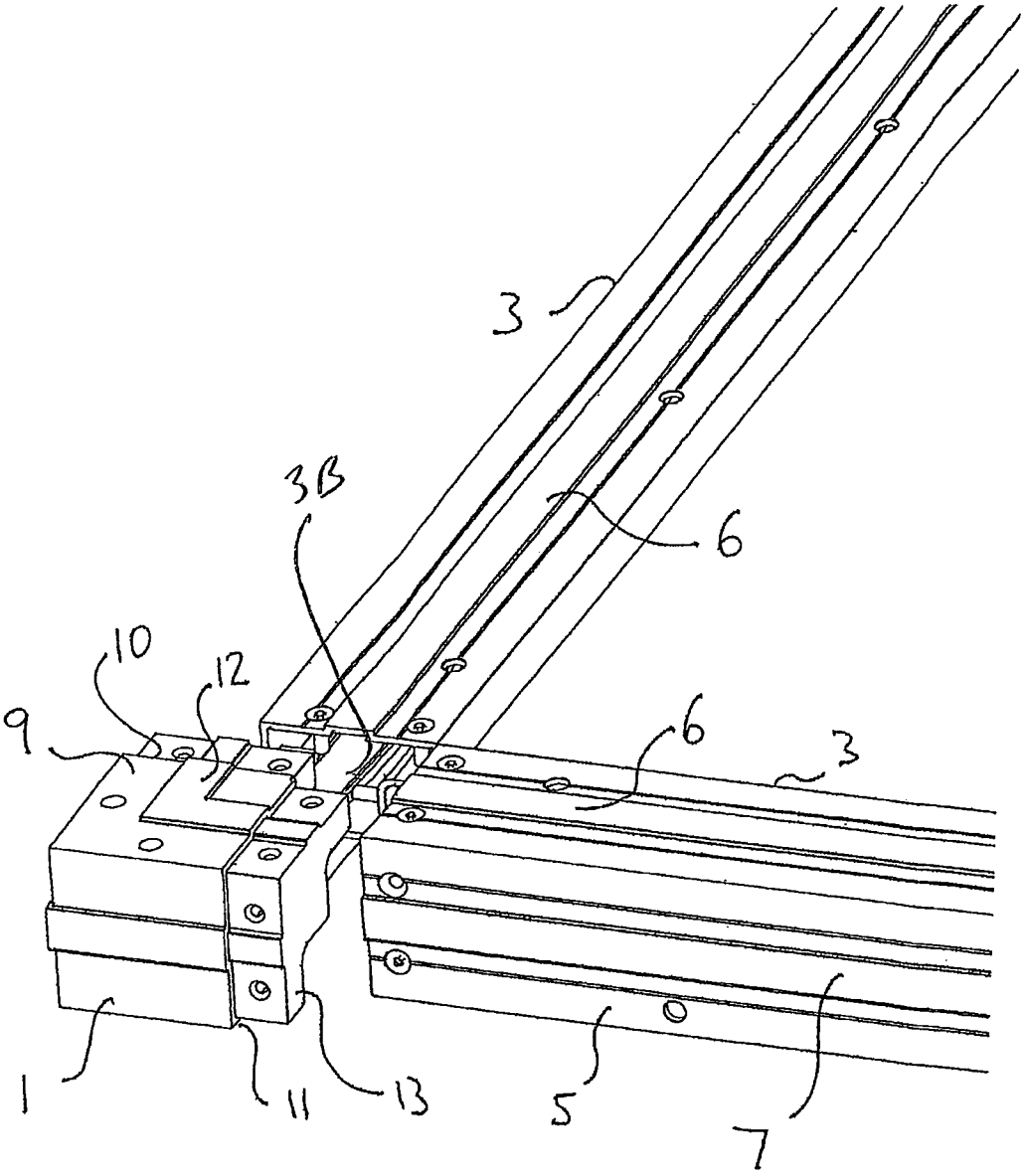
FIG. 6 is an exploded isometric view of a connector member of FIG. 5 connecting two elongate beam members of the present invention.
Figures 42, 43, 44, 45, 46, 47:
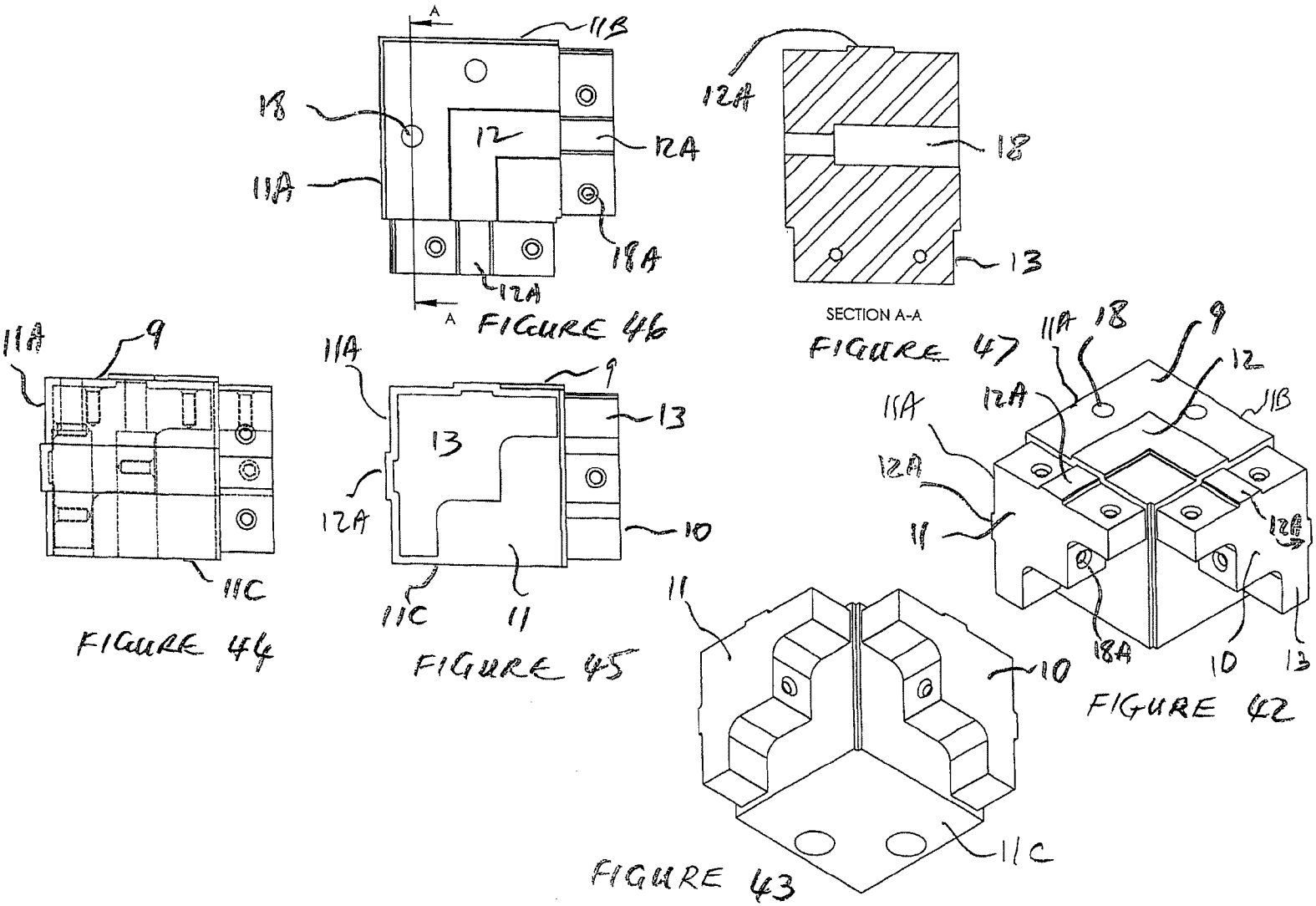

FIG. 42 shows an upper perspective view of the connector as shown in FIG. 5

FIG. 43 shows a lower perspective view of the connector of FIG. 38

FIG. 44 is a cross sectional side view of the connector

FIG. 45 is a side view of the connector

FIG. 46 is a top plan view of the connector

FIG. 47 is a Section AA from FIG. 42

Wall Frame Units—for Mounting Cladding

FIG. 48 is a front view of the wall frame unit.

FIG. 49 is a side view of one member of the wall frame unit.

FIG. 50 is a first side view of another member of the wall frame unit.

Figure 52:
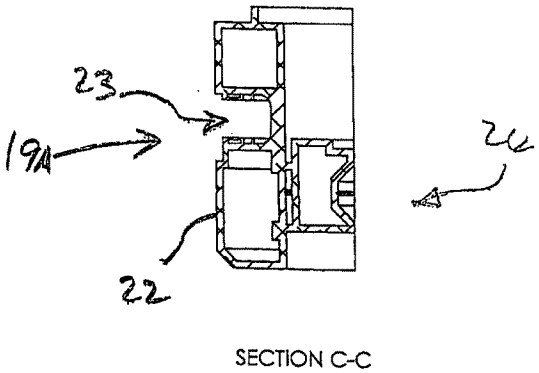
Figure 51:
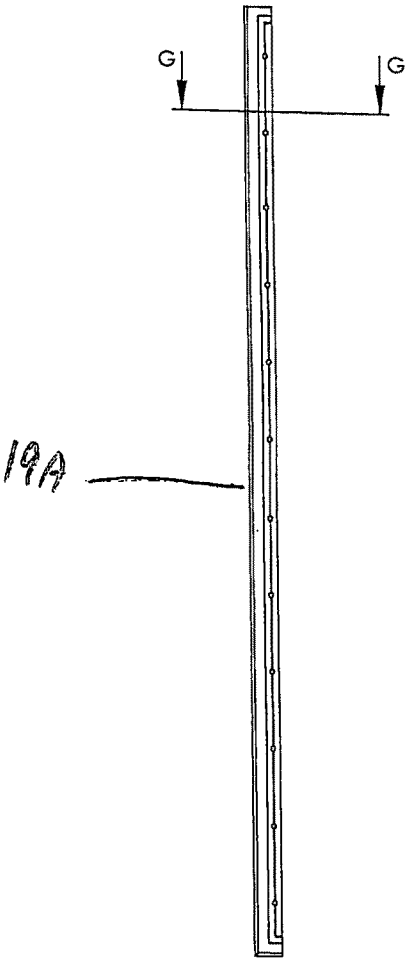

FIG. 51 is a second side view of the one member of the wall frame unit like FIG. 49 showing location of Section GG FIG. 52 is a cross section GG end view of the member located in FIG. 48 similar to FIG. 9

Figure 53:
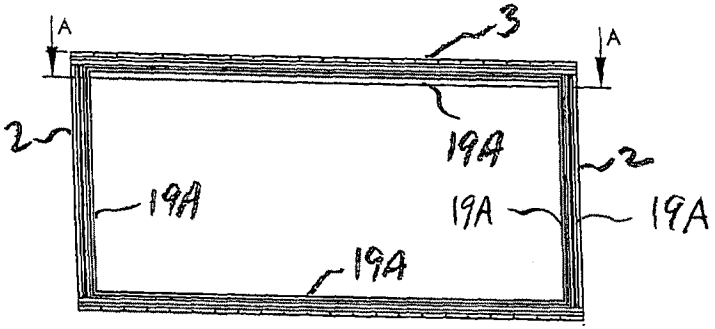

FIG. 53 is a side view of one side of a cuboid

Figure 54:
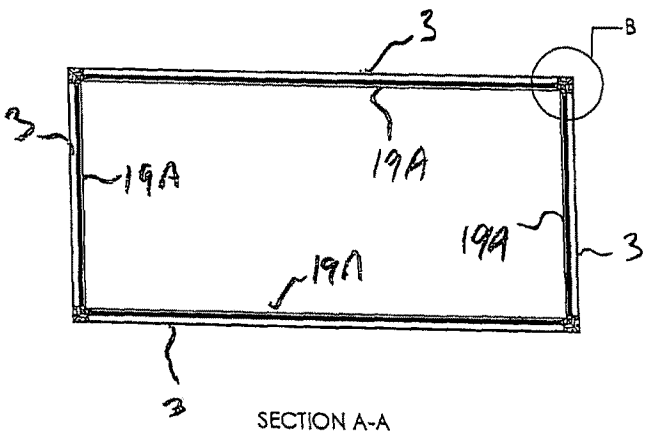

FIG. 54 is a top plan view of the top of the cuboid

Figure 55:
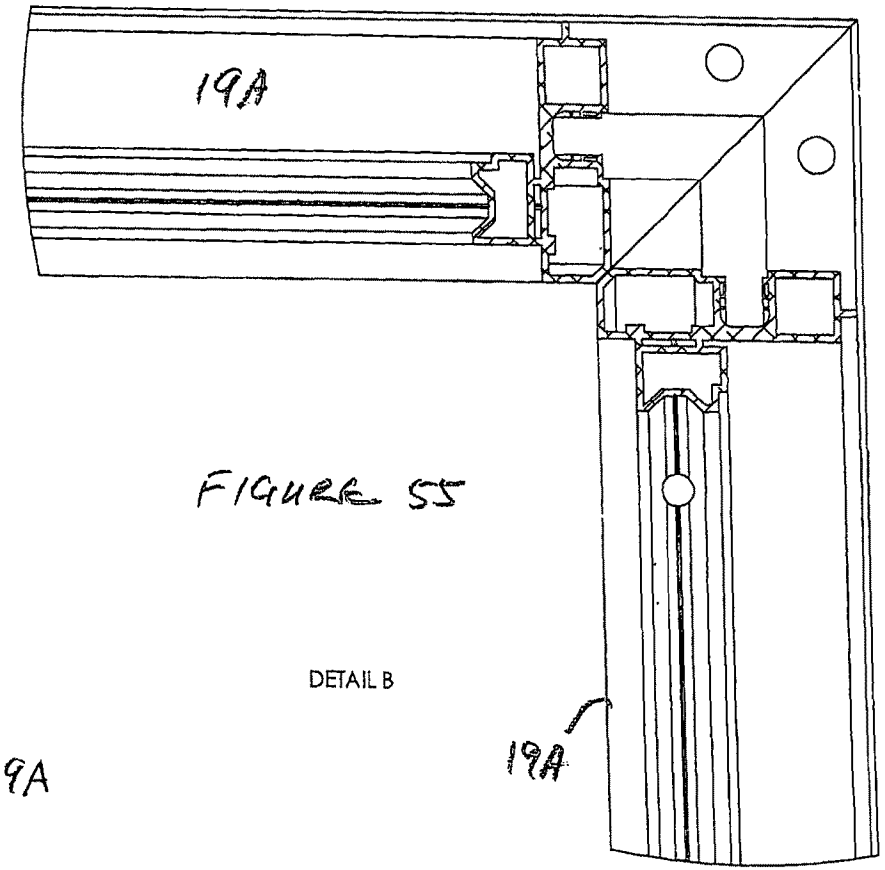

FIG. 55 is a close up corner cross sectional view without the column shown

BRIEF DESCRIPTION OF POSSIBLE EMBODIMENTS OF THE INVENTION

Referring first to FIGS. 1-55, the present invention comprises a modular building system comprising at least one connector member or connector member 1, at least one column member 2 and at least one beam member 3 connected together to form a substantially cuboid frame or cube, generally referenced by arrow 100. Though the term "system" is used to describe the invention made up of various parts or component that physically interact with each other to form an erected or construction frame or portion of a building, the word "system" can be swapped for other similar words such as "assembly" if required.

The column member 2 and beam member 3 are elongate hollow members, formed from for example aluminium extrusions. In the embodiment shown the hollow portions of the column member 2 and beam member 3 have substantially identical transverse cross-sections.

As best seen in FIGS. 2, 4, 19 and 41, the column and beam members 2, 3 comprise a body with an outer surface first face 4 and a substantially orthogonal second face 5 and an inner surface.

The first and second faces 4, 5 are provided with respective protruding keying portions 6, 7. In the embodiment shown the keying portions 6, 7 comprise broad raised ribs which extend continuously over substantially along the entire length of the respective member. The raised ribs are preferably provided in substantially the centre of the respective faces 4, 5.

Figure 4:
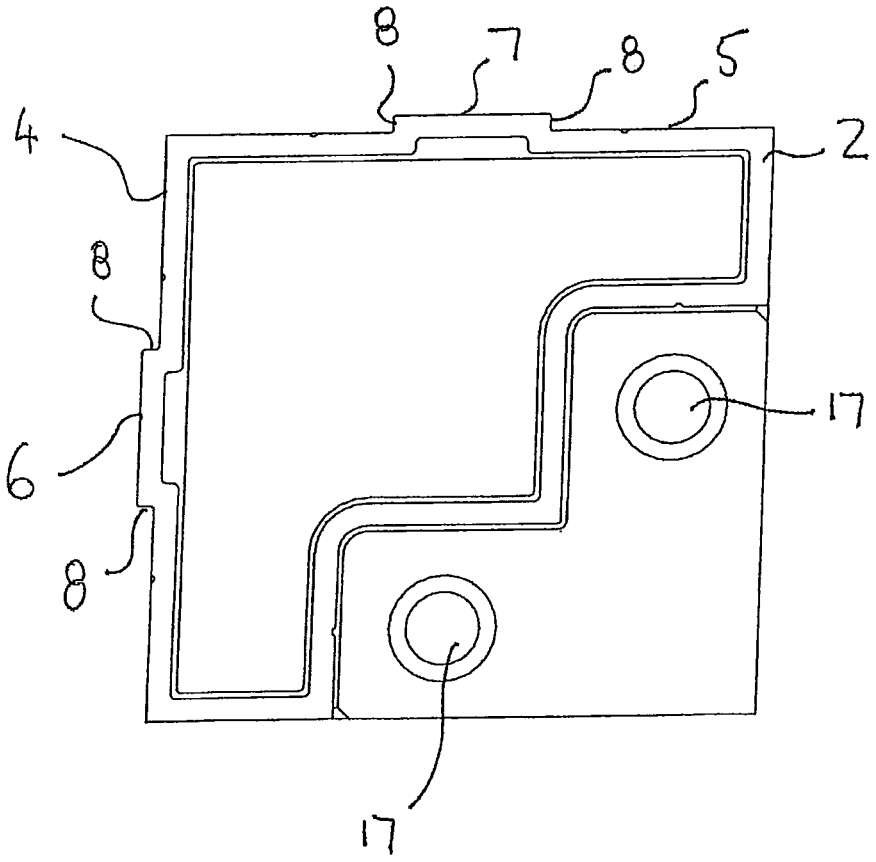
FIG. 4 Is a plan view of the elongate column member of FIG. 2 with keying portions, with an upper end cap member removed for clarity.

As best seen in FIG. 4, the keying portions 6, 7 each have at least one, at least two, keying surfaces 8. The keying surfaces 8 extend substantially perpendicularly to the face 4, 5 on which the keying portion 6, 7 is provided, although some deviation from the perpendicular may be allowable (for example up to 30 degrees deviation). In one embodiment each keying surface of a given keying portion 6, 7 is substantially parallel to each other keying surface of that keying portion, although in cases where the keying surfaces 8 are not perpendicular to the face 4, 5 the surfaces of a given keying portion may not be parallel.

Figure 4A:
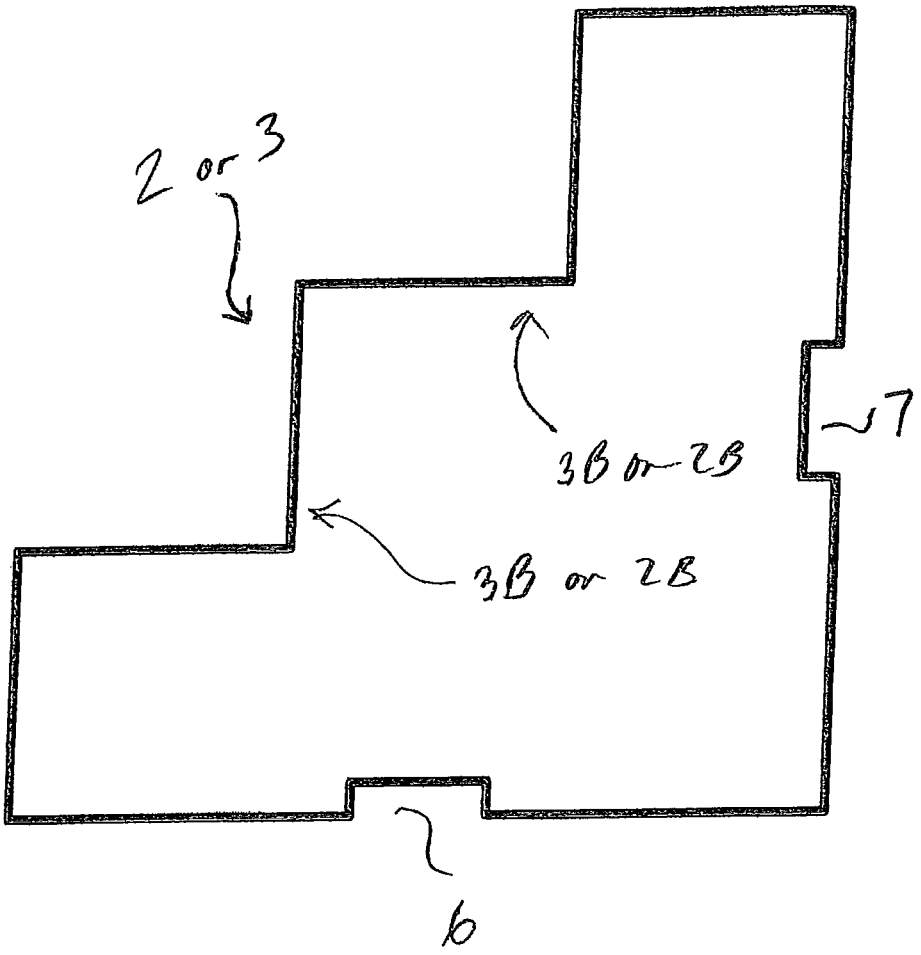
FIG. 4A Is a diagrammatic transverse cross-section view of an alternative elongate column member (with keying portions as slots), with both end cap member removed for clarity.

In the embodiments shown the keying portions 6, 7 protrude from the plane of the face 4, 5, although in other embodiments the orientation of the keying portions 6*a*, 7*a* may be reversed such that they extend inward of the member 2, 3 to form a channel, groove, slot or similar, as shown in FIG. 4A. Such formations also have at least one keying surface 8.

In embodiments of the invention for which weathertightness is a factor, the keying portions 6, 7 of the beam member 3 are protruding, rather than recessed.

The column and beam members 2, 3 also comprise a substantially stepped profile between the distal edges of the first and second faces 4, 5, as shown in FIGS. 4, 4A, 15, 19 and 41. In use the stepped profile faces inwardly of the frame with the key ways 6, 7 facing outwardly of the frame. As seen in FIGS. 16, 20, 22, 25, 28 and 30, beams 3 and/or columns 2 can have access way slots 3A for utilities or services therein and there through. In use the stepped face of the beams faces inward of the cuboid while the columns stepped face, faces outwardly as seen FIGS. 1 and 7. In the interior of the elongate members the stepped formation 3B or 2B has rounded corners to match the rounder corners in the connector member 1.

Connector Member 1

Referring next to FIGS. 5, 6, 37, and 42-47 in particular, the connector member 1 includes a body which can be a substantially cuboid or box shape, and has a first face 9, and second and third faces 10, 11 which are mutually orthogonal, and are orthogonal to the first face 9.

In use first face 9 can be oriented in a substantially horizontal plane, with second and third faces 10, 11 being vertical or in a vertical plane in orientation and formed on an in use inner face (ie facing inwardly of the frame) of the connector member 1 body being connectable to the beams 3. Connector member 1 can also have fourth and fifth faces 11A and 11B which can also be substantially vertical in vertical plane in orientation and at right angles to each other, and being formed on an outer face of the connector member body and in use being in front or facing outwardly of the cuboid or frame. Further connector member can have a sixth face 11C being substantially horizontal or parallel to first face 9 (and spaced there from) and oriented at right angles to second, third, fourth and fifth faces 10, 11, 11A, 11B whereby first face can be in use termed an upper face and sixth face can be a lower face. The sixth face 11C can be on the bottom or foundation when the connector member 1 is on the bottom of the frame or if the connector member 1 is on the top corner of the frame, face 11C will be on the very top.

The first face 9 of the connector member is provided with a protruding keying portion 12. In the embodiment shown the keying portion 12 comprises a broad raised rib which is substantially I' shaped, and extends in a downward step along an edge of the mating formation 13 and extends between the intersection of the first and second faces 9, 10 and that of the first and third faces 9, 11. The profile the keying portion 12 is substantially identical to the profile of the keying portions 6, 7 of the column and beam members. Additionally the keying formation of 7 (vertical) is in line and level with keying portion 12A on front faces 11A and 11B and mating formation on the same vertical front side also has its keying formation in line but stepped inwardly to allow the end of the elongate member to slidably engage and be level with the front faces of the connector member 1.

The second and third faces 10, 11 are provided with mating formations 13 which are adapted to slidably engage an interior of similar shape in the hollow beam members 3. In one embodiment the mating formations 13 have a substantially complementary exterior profile to the interior profile of the beam members 3 to allow inter-sliding there between in a male/female interaction. Mating formations 13 as shown in FIGS. 5 and 38 also have a keying portion 12A being smaller in shape than keying portion 12 but being co-linear and on the same first face 9 and also being located on an outer face of mating formation 13 on the fourth face 11A and 11B (vertical front faces). The mating formation 13 is recessed with respect to the first face 9 and the vertical faces 11A, 11B to allow the end of a beam or column to sit snuggly over and not protrude beyond the main body of the connector member 1. The stepped shape has rounded corners which also match rounded corners in the elongate beam members 3.

In other embodiments the mating formations 13 may not conform exactly to the interior profile, but may still be shaped to provide a positive engagement between the connector member 1 and a beam member 3 to which the connector member is connected when in use. In use, suitable fasteners may extend through the second face 5 of the beam member 3 and into the mating formation 13 in order to lock the beam member 3 into engagement with the mating formation 13, although in alternative embodiments the components may be welded together, or connected by other suitable means.

Additionally connector member 1 is provided with first apertures 18 and second apertures 18A. First apertures 18 are located on the first face 9 (not in the keying formation 12) extending downwardly to the opposite parallel face 11C which is designed to provide a vertical fixing with a fastener therein to threadably or bolt the connector member 1 to the end cap member 14 of the column 2.

Second apertures 18A are provided on the same oriented face as first face 9 but are located on an edge of the mating formations 13 and the other edge of the mating formations 13 as two pairs of apertures covering both directions. Additionally further second apertures 18A are provided on the middle of the stepping surface as shown in FIG. 43 which means that each matting formation 13 can have two second apertures on the edge and one on the middle step. The first and second apertures 18, 18A can also be used for inserting a removable pin therein for allowing vertical stacking of the horizontal floor or roof frames and allow fixing to the end of the elongate member.

The connector member 1 is shown in FIG. 37 in an upright position at the top of a column member 2 but when the connector member 1 is used at the bottom of the column member 2 it is oriented as seen in FIG. 43 ie upside down.

Cuboid to coboid is possible because of the spaced bolt holes provided in all the beams and columns.

End Cap Member 14

As best seen in FIGS. 3 and 31-36, the end cap member s 14 of the column members 2 comprise an end cap member body with an outer face 15 which is provided with female keying portions 16 in a cross shape which are shaped and dimensioned to engage the keying portions 12 on the first face 9 of the connector member 1. In this way the column 2 is prevented from moving laterally and/or rotating when connected to the first face 9 of the connector member 1. The end cap member s 14 are provided with at least one, and preferably two apertures 17 therethrough which align with apertures 18 (FIG. 5) provided in the connector member 1 in order to allow the components to be fastened together with suitable fasteners, typically bolts. In a preferred embodiment internally threaded stainless steel inserts (not shown) are pressed into the apertures 18 to engage with the bolts.

End cap member body also has an inner face 15A (see FIG. 31) being oriented parallel but spaced from outer face 15 by side faces 15B, 15C, 15D and 15E. Side faces (15B and 15D) are oriented in parallel with each other and side faces (15C and 15E) are oriented parallel with each other but are at right angles to side faces 15B and 15D). End cap member body includes the Inner face 15A which is formed as a protruding portion from one side of the body being an L step shaped protruding portion as seen more clearly in FIG. 36 which is shaped to be slidably received by the stepped formation of one end of a column as seen in FIG. 3.

Inner face 15A is also recessed with respect to its side surface to allow it to be completely covered by the end of the column with the column 2 forming a flush outer surface with the end side of the capping member 14. Also there is a protruding portion 15F which protrudes beyond 15A which has fixing apertures which when in use align with the holes or apertures 18 in the connector member and when in use being connected to the column, protruding portion is position outside of the elongate member 2

As is shown in FIGS. 3, 34 and 35, the female keying portions 16 are provided in a substantially cruciform or cross shape, so that the column members 2 can be positioned at any required intermediate position along a beam member 3, for example to support an internal wall. The column members with cap member can be located anywhere within the frame F to provide for extra support for other wall installations.

As can be seen in FIG. 1, and 13-24, the beam members 3, column members 2 and connector member 1 can be interconnected to form a substantially cuboid frame 100. The frame 100 defines six faces, labeled F, each face being defined by four beam members 3 (in the case of the two substantially horizontal faces) or two beam members 3 and two columns 2 (in the case of each of the four substantially vertical faces). At least one keying surface from each column or beam member 2, 3 which defines any given face F extends parallel to the face F, as seen in FIG. 7.

Wall Frame Units for Mounting Cladding

Referring next to FIGS. 8-13 and 48-55, one or more wall frame units 19 may be provided for each of the substantially vertically orientated faces F. The wall frame units 19 are provided with interconnected or joined, elongate hollow box channel members 19A having keying portions 20 which are complementary to the keying portions 6, 7 of the column and beam members 2, 3, and/or which have keying surfaces 21 which can engage with the keying surfaces 6, 7 of the beam and column members. For example, in the embodiments shown, an outer side face 22 of the wall frame units 19 is provided with channels 23 which are shaped and dimensioned to engage the keying portions 6, 7 of the columns 2 and beams 3. In the embodiment shown the profile of the channel 23 comprises a plurality of grooves 23*a* which are shaped to also accommodate a sealing element, for example a rubber seal or a felt or "mohair" type weather strip.

The wall fame unit 19 shown in FIGS. 8-13 and 48-52 extends up the full height of the column 2 and along the full length of the beams 3. Building elements such as windows and/or doors may be installed within the wall frame, with the use of suitable framing and/or bracing members (not shown) as and when required. Accordingly, a face F of the frame 100 typically comprises at least one wall frame unit 19 to mate interlock, key, engage male 6, 7 and female vertical keyways ie channel 23 within a face F. However, in some embodiments a plurality of wall frame units 19 of differing dimensions may be provided within a single face. Similarly, the wall frame unit 19 need not fill the entire face F. For example, in some embodiments a space may be left between the upper member of the wall frame element and the upper beam 3 of the frame 100.

As best seen in FIGS. 8 and 9, wall frame units 19 which are used for mounting interior cladding are provided with one or more removable flange member or flange member 24. The flange member 24 comprise at least one, and preferably two mounting surfaces 25 which extend substantially parallel to the plane of the wall frame unit 19. The flange member 24 is a separate component to the wall frame unit 19, and is connectable by any suitable connection means, for example a "snap fit". In this way the configuration of the flange member 24 is flexible.

As can be seen in FIG. 9, each hollow elongate member 19A is shaped as a flat box channel like member made of three separate but joined or connected elongate box channel members ie a first channel member 31, a second channel member 32 and third channel member 33. The first and second box channel members are oriented with respect to each other to form channel 23 there between with a base conjoined with a base of the first and second channel members. Third box channel 33 forms the flange member 24 which can be removably located as seen in FIG. 8 at an upper or lower portion of the hollow elongate member 19A or adjacent to the first or second channel box members 31, 32. Flange member 24 is shaped as protruding elongate hollow members having an outer grooved portion, which are located on an opposite face (ie inner side face 22A) of the outer side face 22 of the hollow elongate member 19A. Third box channel member 33 is designed to peripheral hold any window glazing or doors therein and is seated within the member 19A to allow for any external flashing thereon.

There is a rib 30 on the bottom of wall frame unit 19 as seen in FIG. 9 which allows for the utilization of window and door extrusions to lock and seal on the exterior surface of the wall frame. Also the top edge but in is the inner edge is beveled at 30A to allow meeting of the hollow elongate member 19A at a corner to not interfer with each other.

Those skilled in the art will appreciate that the structure created by the frame 100 in combination with the wall units 19 is particularly strong and well braced, due to the interconnection between the keying portions and/or keying surfaces of the components. For example, as best seen in FIGS. 12 and 13, each column 2 is braced in two planes by the wall frame units 19 engaged with the first and second faces 4, 5 of the column.

If larger, more complex shapes are to be created then a plurality of frames 100 may be connected together, side by side, and one on top of another. Suitably shaped joist members may be provided between the beam members 3 to support flooring, ceiling and roofing members.

Similarly, frames 100 may be connected one above the other to create larger shapes, for example multi-storey buildings. The wall frame bolts (being rivetnuts—self tightening) to the columns and beams with the slots of wall frame being received by the key portion of the beams and columns. The slot 23 of the wall unit 19 or member 19A assist in aligning the wall unit to the cuboid. As seen in FIG. 49 the members of the wall frame also have utilities slots 19B through removable flange 24 and rear of one of the box sections 31 or 32 to line up with the utilities slots 3A in the beams 3 as in FIGS. 25-28.

Example Methods of Construction

Each unit consists of:

8× uniform beams 3, 8× uniform blocks, 4 columns or posts 2, 4 exterior cladded walls, floor support beams (quantity is dependant on use, i.e. load rating), ceiling support beams (for stacked units) or roof components (roof styles other than flat) and fasteners.

System can be shipped as a flat pack. Four walls are bundled to provide protection from damage during shipping. The four posts are bundled and four roof/floor beams are bundled and the corner blocks shipped in a box with fasteners and tools.

External Walls

Walls can come cladded in retail sales. This allows integrity in exterior weather tightness when installing the external walls. Siding options are available in wood, aluminium and composite materials. Methods of fastening differ depending on use and strength required. Some fastening methods are bolt, weld, rivet, adhesive and nail.

Commercial users can purchase the units in raw structural form.

Assembly of Cube eg Like as Shown in FIGS. 1, 13 a) Unpack items and inspect for damage;

b) Find a suitable foundation or use plate/blocks on ground to provide a safe grounded area for the construction;

c) Install blocks on one side of all beams using the fasteners provided. Assemble 4 beams into the floor frame;

d) Install floor support beams and flooring substrate (plywood or composite material);

e) Tighten all flooring and flooring beams fasteners;

f) Fasten column onto one wall end, lift and lock wall into the floor beam utilizing the vertical and horizontal keyway system;

g) Fasten column first then install fasteners on the inside of wall. Amount of fasteners depends on strength needed;

h) Repeat step 4.5 until all 4 walls are completed upright and secure;

i) Install blocks on one end of the ceiling beams. Install one beam and secure with fasteners loosely;

j) Repeat this for all 4 beams then tighten fasteners;

k) Install ceiling beams for stacking or flat roof or roof components to complete the weather tight construction.

Standard roofing is available in 3 different shapes such as pitched roof, arched roof, mono roof and flat roof. The material for the roofing can be aluminum, composite or coated sheet metal. Roof trusses can be made of aluminium in standard applications. They are comprised of 3 to 4 trusses depending on loading (snow) and roofing panels allowing easy construction. The ends are closed out using a modular end.

Because the frames meet residential structural construction standards it is an option to truss the system with wood. The buildings can be used in traditional construction style for additions and Install trusses in pre-designated locations. Thru bolt these to the ceiling frame with the supplied fasteners.

Install panels in numbered locations

Installed end panels and clerestory panel if part of your roof package.

The building now meets exterior weather tightness.

Joining Buildings

Buildings formed as cube with one building being referred to as a primary structure, can be joined to create larger structures using a joining kit. Currently structural approval is required for horizontal growth but there can be structural approval for more than one level such as for 2 and 3 level buildings. Joining a building simply requires two, two sided structures, the removal of the wall from one building and a two sided structure which becomes three sided structure with the reuse of the removed panel from the first structure.

The Joining Kit Includes 2 predrilled metal strips (6 mm), 2 exterior flashing strips, 1 roof flashing strip, 2 Interior flashing plates and fasteners. Make sure the ground surface is level with the primary structure. This is not absolutely necessary as the loads are carried across top and bottom Roof/Floor beams.

A joining method can include the following steps:

a) Mate the 2 buildings as closely as possible;

b) Install the predrilled metals strips between the roof and floor beams and cross bolt using the fasteners provided and tighten these;

c) Install the Interior flashing plate using the supplied fasteners;

d) Install the Roof flashing strip only after the above step has been completed;

e) Install the exterior flashing strip.

Those skilled in the art will appreciate that preferred embodiments of the invention provide a strong, flexible construction system which is relatively lightweight, and is reusable and/or recyclable, with near zero waste. The system may be constructed by an unskilled worker using as few as three tools.

Advantages

- lightweight construction making them easier to transport and handle
- simple assembly
- able to use unskilled labor to assemble
- two people can be used to carry out assembly
- system is modular
- system includes components that can be easily added or removed and be recyclable robust construction with specified strength
system can be flat packed
minimal tools required for assembly eg allen key and screw drive
simple bolting system accessible only from one side or in use from the inside
secure system not able to be access from outside
can be retrofitted to any existing structures or build as new
requires few tools ie 3 tools for construction using only bolts and rivnuts
wall frame units designed to be non load bearing
cuboid frame is designed to be load bearing Variations Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to".

The columns, beams, connector member and end cap members can be manufactured or fabricated from any material and can be solid or hollow or be made up of joined or connected components. Keying portions 6 and 7 can be any shape and extent as long as they can slidably interlock together. The stepped profile can be varied or formed in other shapes such as for example more steps or different angles.

Where in the foregoing description, reference has been made to specific components or integers of the invention having known equivalents, then such equivalents are herein incorporated as if individually set forth.

Although this invention has been described by way of example and with reference to possible embodiments thereof, it is to be understood that modifications or improvements may be made thereto without departing from the spirit or scope of the invention.

It will also be understood that where a product, method or process as herein described or claimed and that is sold incomplete, as individual components, or as a "kit of Parts", that such exploitation will fall within the ambit of the invention.

These and other features and characteristics of the present invention, as well as the method of operation and functions of the related elements of structures and the combination of parts and economics of manufacture, will become more apparent upon consideration of the following description with reference to the accompanying drawings, all of which form part of this specification, wherein like reference numerals designate corresponding parts in the various figures.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

For purposes of the description hereinafter, the terms "upper", "lower", "right", "left", "vertical", "horizontal", "top", "bottom", "lateral", "longitudinal", "side", "front", "rear" and derivatives thereof shall relate to the invention as it is oriented in the drawing figures. However it is to be understood that the invention may assume various alternative variations, except where expressly specified to the contrary. It is also to be understood that the specific devices illustrated in the attached drawings, and described in the following specification are simply exemplary embodiments of the invention. Hence specific dimensions and other physical characteristics related to the embodiments disclosed herein are not to be considered as limiting.

What we claim is:

1. A construction system comprising a first elongate member, a second elongate member and a connector member, each of the first and second elongate members comprising an interior engaging portion, the connector member includes a protruding keying portion and first and second mating formations, wherein, when the second elongate member is engaged with the connector member in use, the interior engaging portion slidably receives one of the first and second mating formations therein, and wherein none of the first elongate member, the second elongate member, and the connector member have any moving parts thereon, wherein the connector member has a body that is generally box shaped and comprises an exterior surface having a first face, a second face, and a third face wherein the first face lies entirely within a first plane, the second face lies entirely within a second plane, and the third face lies entirely within a third plane, the first face providing a horizontal surface with the protruding keying portion thereon, the second face and the third face each providing a vertical face, the second face having the first mating formation thereon and the third face having the second mating formation thereon, wherein the second face and the third face are mutually orthogonal and are also orthogonal to the first face, the body comprising a fourth face and a fifth face oriented generally at a right angle to each other, the fourth face having a fourth face protruding keying portion thereon and the fifth face having a fifth face protruding keying portion thereon, the protruding keying portion extending in an "L" shape on the first face and extending in a downward step along a first surface of the first and second mating formations, wherein a first width of the protruding keying portion is less than a second width of the first surface of the first and second mating formations upon which the protruding keying portion extends, the fourth face protruding keying portion extending in a downward step along a second surface of the first mating formation and the fifth face protruding keying portion extending in a downward step along a second surface of the second mating formation, wherein the protruding keying formation of the first face and the fourth and fifth face protruding keying formations have no through-holes therein, the first and second mating formations extending outwardly away from the second and third planes, respectively, a greater distance than a distance that the protruding keying formation extends outwardly away from the first plane, wherein the interior engaging portion of the second elongate member is provided in at least an end portion of an interior of a body which is shaped to slidably engage with one of the first and second mating formations of the connector member wherein the interior engaging portion has a stepped shape as a female part and the mating formation is provided by a stepped formation as a male part, wherein an interior profile of the end portion of the second elongate member is identical to an exterior profile of one of the first and second mating formations, the interior profile of the end portion having second member keying portions that are configured to engage the protruding keying portion that extends on the first surface of the one of the first and second mating formations and the fourth face protruding keying portion that extends on the second surface of the one of the first and second mating formations, respectively, such that a profile of the second member keying portions are identical to the profile of the protruding keying portion on the first face and the fourth face protruding keying portion, respectively.

2. The construction system as claimed in claim 1 wherein, each of the first and second elongate members comprise an elongate member body with two substantially orthogonal faces, each said face comprising an elongate member protruding keying portion wherein the elongate member protruding keying portion of the first elongate member extends substantially in-plane with the elongate member protruding keying portion of the second elongate member.

3. The construction system as claimed in claim 1 wherein, the second member keying portions extend over substantially an entire length of the second elongate member.

4. The construction system as claimed in claim 1 wherein each of the second member keying portions are substantially continuous.

5. The construction system as claimed in claim 1 wherein each of the second member keying portions comprise a raised rib located on an outside surface of the second elongate member.

6. The construction system as claimed in claim 1 wherein the first elongate member is provided with at least one end cap member slidably received in at least one end of the first elongate member wherein an outer surface of the at least one end cap member includes female keying portions in a cross shape, which are adapted to be slidably received by the protruding keying portion of the first face of the connector member.

7. The construction system as claimed in claim 6 wherein the at least one end cap member includes an end cap body with an inner surface wherein the inner surface is shaped to complement and slidably interfit with an interior stepped surface of one end of the first elongate member.

8. The construction system as claimed in claim 7 wherein at least two first apertures are provided in the first face of the connector member and extend down to an opposing sixth face, to provide threading engagement of a fastener therein to engage with the at least one end cap member attached to the first elongate member.

9. The construction system as claimed in claim 8 wherein the first and second mating formations of the connector member are provided with second apertures for the sliding receipt of a removable pin to allow vertical stacking of the floor or roof framed units and fixing to the end of the second elongate member.

10. The construction system as claimed in claim 9 wherein the construction system comprises at least twelve elongate members and at least eight connector members, the elongate members and connector members being interconnectable to form a substantially cuboid frame defining six faces, wherein, when so connected, a keying surface of the elongate members defining each face extends substantially parallel to the said face wherein at least one of the faces is a vertically oriented face.

11. The construction system as claimed in claim 10 wherein the system includes a wall frame unit for attaching cladding thereto, which is shaped to interfit within one of the vertical faces of cuboid frame, wherein the wall frame unit includes elongate channel members having keying portions which are positioned and adapted to be received by being mated and interlocked by receiving by keying portions of the beams and columns to seal the wall frame unit to the surrounding cuboid frame.

12. The construction system as claimed in claim 11 wherein the elongate channel members include three box channels whereby there is an outer and inner surface, with the inner in use facing the elongate members of one face, two of the channels are separated from each other by an open channel on the outer surface and the third box channel is removably connected to the inner face with an outer wall being angled inwardly.

13. The construction system as claimed in claim 12 wherein the open channel includes sealing elements which are shaped and dimensioned to engage the abutting keying portions of the elongate members.

* * * * *